US009815065B2

(12) United States Patent
Boehlefeld

(10) Patent No.: US 9,815,065 B2
(45) Date of Patent: Nov. 14, 2017

(54) DISINTEGRATING MACHINE

(71) Applicant: ERDMANN GMBH & CO. KG, Menden (DE)

(72) Inventor: Michael Boehlefeld, Arnsberg (DE)

(73) Assignee: Erdmann GmbH & Co. KG, Menden (DE)

( * ) Notice: Subject to any disclaimer, the term of this patent is extended or adjusted under 35 U.S.C. 154(b) by 367 days.

(21) Appl. No.: 14/535,513

(22) Filed: Nov. 7, 2014

(65) Prior Publication Data

US 2015/0060583 A1 Mar. 5, 2015

Related U.S. Application Data

(63) Continuation of application No. PCT/EP2013/059301, filed on May 3, 2013.

(30) Foreign Application Priority Data

May 7, 2012 (DE) ..... 10 2012 008 824
Nov. 26, 2012 (DE) ..... 10 2012 022 977

(51) Int. Cl.

| | |
|---|---|
| ***B02C 18/00*** | (2006.01) |
| ***B02C 18/14*** | (2006.01) |
| ***B02C 18/16*** | (2006.01) |
| ***B02C 18/24*** | (2006.01) |
| ***B02C 18/22*** | (2006.01) |

(52) U.S. Cl.

CPC ..... *B02C 18/142* (2013.01); *B02C 18/16* (2013.01); *B02C 18/2291* (2013.01); *B02C 18/24* (2013.01); *B02C 2018/162* (2013.01)

(58) Field of Classification Search

CPC ..... B02C 18/142; B02C 18/16; B02C 18/24; B02C 18/2291; F16C 35/02
USPC ..... 241/236
See application file for complete search history.

(56) References Cited

U.S. PATENT DOCUMENTS

| | | | | |
|---|---|---|---|---|
| 37,510 | A | 1/1863 | Keeler | |
| 699,762 | A | 5/1902 | MacDonald | |
| 4,166,583 | A | 9/1979 | Ruckstuhl | |
| 4,198,005 | A | 4/1980 | Eiff | |
| 4,212,432 | A | 7/1980 | Bohne et al. | |
| 4,653,344 | A * | 3/1987 | Nelson | B65G 25/02 198/774.3 |

(Continued)

FOREIGN PATENT DOCUMENTS

| | | |
|---|---|---|
| DE | 2632330 A1 | 1/1978 |
| DE | 2460484 C2 | 3/1984 |

(Continued)

*Primary Examiner* — Faye Francis
(74) *Attorney, Agent, or Firm* — Laurence A. Greenberg; Werner H. Stemer; Ralph E. Locher

(57) ABSTRACT

A disintegrating machine, in particular a rotor cutter or rotor tearing device, contains at least a first blade shaft, a second blade shaft, a frame, and a driving device for driving the blade shafts. The blade shafts are rotatably accommodated by bearings in bearing receptacles of the frame. The bearing receptacles are configured to improve the maintenance friendliness, in particular by a maintenance-friendly bearing receptacle and/or quick-exchange coupling and/or quickly removable scrapers and/or multifunctional bearing plates and/or by reinforcing ribs, and with regard to a lighter construction while achieving the same or better stability properties.

19 Claims, 23 Drawing Sheets

(56) References Cited

U.S. PATENT DOCUMENTS

| | | | | |
|---|---|---|---|---|
| 4,982,907 | A * | 1/1991 | Sedgwick | B02C 18/0007 241/101.2 |
| 5,681,117 | A * | 10/1997 | Wellman | A01D 57/02 384/441 |
| 5,934,584 | A | 8/1999 | Schwelling | |
| 6,241,170 | B1 * | 6/2001 | St. Clair | B02C 18/0007 241/166 |
| 7,472,854 | B1 | 1/2009 | Bird | |
| 7,789,334 | B2 * | 9/2010 | Wada | B02C 18/142 241/166 |
| 8,201,764 | B2 * | 6/2012 | Pallmann | B02C 18/146 241/167 |
| 2004/0104289 | A1 * | 6/2004 | Schwelling | B02C 18/0007 241/236 |
| 2011/0062263 | A1 * | 3/2011 | Bartelt | B02C 18/142 241/236 |
| 2013/0114920 | A1 * | 5/2013 | Korn | F16C 17/12 384/129 |

FOREIGN PATENT DOCUMENTS

| | | | |
|---|---|---|---|
| DE | 4423424 | A1 | 2/1996 |
| DE | 19641933 | C2 | 6/1999 |
| DE | 19849908 | A1 | 5/2000 |
| DE | 102007040046 | A1 | 2/2009 |
| DE | 102009052750 | A1 | 5/2011 |
| JP | 2003251211 | A | 9/2003 |
| WO | 0185346 | A1 | 11/2001 |
| WO | 2006123441 | A1 | 11/2006 |

* cited by examiner

DISINTEGRATING MACHINE

CROSS-REFERENCE TO RELATED APPLICATION

This is a continuation application, under 35 U.S.C. §120, of copending international application No. PCT/EP2013/059301, filed May 3, 2013, which designated the United States; this application also claims the priority, under 35 U.S.C. §119, of German patent application No. DE 10 2012 008 824.8, filed May 7, 2012 and German patent application No. DE 10 2012 022 977.1, filed Nov. 26, 2012; the prior applications are herewith incorporated by reference in their entireties.

BACKGROUND OF THE INVENTION

Field of the Invention

The present invention relates to a disintegrating machine.

Disintegrating machines with at least two knife shafts are amply known. They serve, for example, for disintegrating recyclable materials, such as, for example, coated copper cables, tires, etc., in order to supply the recyclable materials, for example, to a further recycling process.

Disintegrating machines of this type are exposed to high loads and in particular the knife shafts thereof have to be exchanged from time to time. In the case of disintegrating machines according to the prior art, the maintenance requires a very large amount of time and expense, thus ultimately resulting in high operating costs. There is accordingly a need for improvement in the ease of maintenance of disintegrating machines of this type.

SUMMARY OF THE INVENTION

It is the object of the present invention to provide an improved disintegrating machine, in particular to provide a disintegrating machine which can be easier to maintain.

With the foregoing and other objects in view there is provided, in accordance with the invention, a disintegrating machine selected from the group consisting of rotary cutters and rotary tearing devices. The disintegrating machine contains knife shafts including a first knife shaft and a second knife shaft and a frame having bearing receptacles. At least one of the bearing receptacles has a main body and a bridge being pivotable in relation to the main body. The disintegrating machine further has bearings and a driving device for driving the knife shafts. The knife shafts are accommodated rotatably in the bearing receptacles of the frame by the bearings.

Owing to the fact that at least one bearing receptacle which contains a main body and a bridge which is pivotable in relation to the main body is provided, the knife shafts can be rapidly removed or re-installed since the bearing receptacle can be opened rapidly by swinging up the bridge, and the knife shafts can be correspondingly rapidly removed or, by shutting the bridge, a knife shaft inserted into the bearing receptacle can be rapidly fixed again.

Further advantages of the present invention emerge in particular from the dependent claims. The features of the dependent claims can in principle be combined with one another as desired.

In an advantageous refinement of the invention, it can be provided that the driving device is connected to at least one of the knife shafts by at least one quick change coupling, and preferably the first knife shaft is connected by a first quick change coupling and the second knife shaft is connected by a second quick change coupling to the driving device. By this measure, the knife shaft or the knife shafts can be rapidly separated from the driving device or re-connected to the driving device, and therefore this also enables an easily maintained configuration of the driving device.

In a further advantageous refinement of the invention, it can be provided that at least one scraper, in particular a number of scrapers, is fitted on that side of the frame which faces the knife shafts, wherein the individual scraper are connected to the frame by only one screw and a hook or by only two screws. Therefore, the scrapers can be rapidly removed and installed. This measure also enables an easily maintained configuration of the driving device.

In a further advantageous refinement of the invention, it can be provided that at least one knife shaft, preferably two knife shafts, are equipped on the end side with at least one bearing plate. The bearing plate is equipped with a standing foot which, with respect to the axis of rotation of the knife shaft, is at a greater distance from the axis of rotation than the largest radius of the knife shaft. Optionally, the bearing plate is provided with an opening for the hooking-in of a crane hook or for connection to a crane, and/or the bearing plate is equipped with a connection for the bearing of the knife shaft. By this means an easily maintained disintegrating machine can likewise be provided. It is noticeable here in particular that the bearing plate can take on numerous tasks and can therefore be referred to as multifunctional. The standing foot also enables the knife shaft to be placed, for example, on the ground or on a suitable work bench without the knives of the shaft itself, or the ground or the underlying surface being affected. Through the hooking-in opening, the knife shaft can be hooked in and lifted out or inserted directly on the bearing plates by crane. A separate fastening, for example by straps, chains or belts, can be dispensed with. The bearings of the knife shafts are basically held by the bearing receptacles of the frame. In addition, the bearings can also be accommodated and fixed by corresponding connections in the bearing plates.

In a further advantageous refinement of the invention, it can be provided that the frame is equipped with reinforcing ribs at least in sections, in particular reinforcing ribs running diagonally between the corners of the side walls. By this means, it is possible for the construction to be lighter in weight with the same or even greater stability of the disintegrating machine. For example, given an identical anticipated load, the frame can be configured to be thinner or of a different material than it would have to be without reinforcing ribs for an anticipated load.

In a further advantageous refinement of the invention, it can be provided that the frame contains at least a first side wall, a second side wall, a first end wall and a second end wall, which preferably form a rectangular frame. Two knife shafts can advantageously be accommodated in a rectangular frame, in particular parallel to the side walls.

In a further advantageous refinement of the proposed invention, it can be provided that a first bearing receptacle, containing a main body and a bridge which is pivotable in relation to the main body, is provided in the first end wall or form the first end wall, wherein a second bearing receptacle, containing a main body and a bridge which is pivotable in relation to the main body, is provided in the second end wall or form the end wall. The bridges each have two semicircular recesses and the main bodies each have two semicircular recesses. In a closed state of the bridge and the main body, that is in an operating state of the disintegrating machine, the semicircular recesses of the main body and the bridge complement each other to form two receptacles for one bearing each of the two knife shafts, that is, with two bridges and main bodies configured in such a manner, a total of four receptacles for the four bearings of the two knife shafts can be provided in the disintegrating device. It should be noted that the knife shaft can also be mounted with more bearings. The description is based here on a standard mounting by two bearings per knife shaft. To the extent that the combination of the main body and the bridge complement each other in a closed state to form a wall, the combination can be entirely used as the end wall. In principle, it is also possible for more than two semicircular recesses to be provided per main body or bridge, and therefore correspondingly more knife shafts can also be accommodated in the respective bearing receptacle and, by this means, disintegrating machines with more than two knife shafts can also be realized.

In a further advantageous refinement of the invention, it can be provided that the disintegrating machine contains a hopper for supplying recyclable materials to the knife shafts, wherein the hopper is fitted to at least one bridge, preferably to the bridge of the first bearing receptacle and to the bridge of the second bearing receptacle. The hopper can be screwed to a follow-up pressing device which assists the supply of material. If the hopper is fitted to the bridge, which is pivotable in relation to the main body, preferably to the two bridges, which are pivotable in relation to the main bodies, it is then possible, to a certain extent in one working step, for the hopper, optionally including the follow-up pressing device, to be pivoted to the side and for the knife shafts to be exposed for removal. After the knife shafts have been repaired or after new or different knife shafts have been inserted, the bridges can be swung back again, as a result of which, first, the hopper, optionally together with the follow-up pressing device, is pivoted again into an operating position and, second, the bearing receptacle can be closed again.

In a further advantageous refinement of the invention, it can be provided that a play-free, but at least play-reduced, bearing is provided between the main body and the bridge. This results in a play-reduced, preferably play-free, mounting of the bridge, which, in turn, permits a flow of forces directly into the frame. In addition, the bearing is preferably maintenance-free.

In a further advantageous refinement of the invention, it can be provided that at least one releasable fixing device is provided between the bridge and the main body. Correspondingly, a plurality of releasable fixing devices can also be provided.

In a further advantageous refinement of the invention, it can be provided that the main body is of a U-shaped configuration and has a longitudinal side, a first limb and a second limb, wherein the bridge is of a L-shaped configuration and has a longitudinal side and a limb. The fixing device contains at least two bores in the second limb of the main body, two threaded bores on the end side of the longitudinal side of the bridge and two screws, wherein the two bores run parallel to the longitudinal side of the main body and the threaded bores run parallel to the longitudinal side of the bridge. The screws are screwed through the bores into the threaded bores. Optionally the fixing device may contain at least one bracket with a pivotable threaded rod on the main body or on the bridge, and at least one receptacle on the bridge or on the main body. The threaded rod can be pivoted into the receptacle and fixed by a nut. Further optionally the fixing device may contain at least a first bore and a second bore in the bearing plate and a threaded bore in the main body and a threaded bore in the bridge and two threaded bolts. The threaded bolts are screwed through the bores into the threaded bores. Yet further optionally the fixing device may contain a first semicircular bore in the bridge and a second semicircular bore in the main body. The first and second bores complement each other in an operating state of the disintegrating machine to form a circular bore, and a securing bolt is inserted releasably into the bore.

The bolts, bores and fixing device permit a play-free, but at least play-reduced, connection of main body and bridge, which realize a frictional connection in the direction of the main body.

In a further advantageous refinement of the invention, it can be provided that the quick change coupling contains a first flange and a second flange. Wherein both the first flange and the second flange have merely three bores each for screws for connection of the flanges, and only one carrier is arranged between the flanges. A quick action coupling with only one fixedly mounted carrier element facilitates the removal of the shafts by release of only three screws per coupling.

In a further advantageous refinement of the invention, it can be provided that the reinforcing ribs are fitted to the side walls.

In a further advantageous refinement of the invention, it can be provided that the reinforcing ribs run diagonally between the corners of the side walls.

In a further advantageous refinement of the invention, it can be provided that the connection of the bearing plate for the bearing of the knife shaft is provided in the form of a bearing ring, wherein the bearing ring and the bearing plate are either formed integrally or the bearing ring is connected to the bearing plate. The bearing can be accommodated more advantageously in the bearing receptacle via the bearing ring, and in particular the outer ring of the bearing is protected by the bearing ring.

Other features which are considered as characteristic for the invention are set forth in the appended claims.

Although the invention is illustrated and described herein as embodied in a disintegrating machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
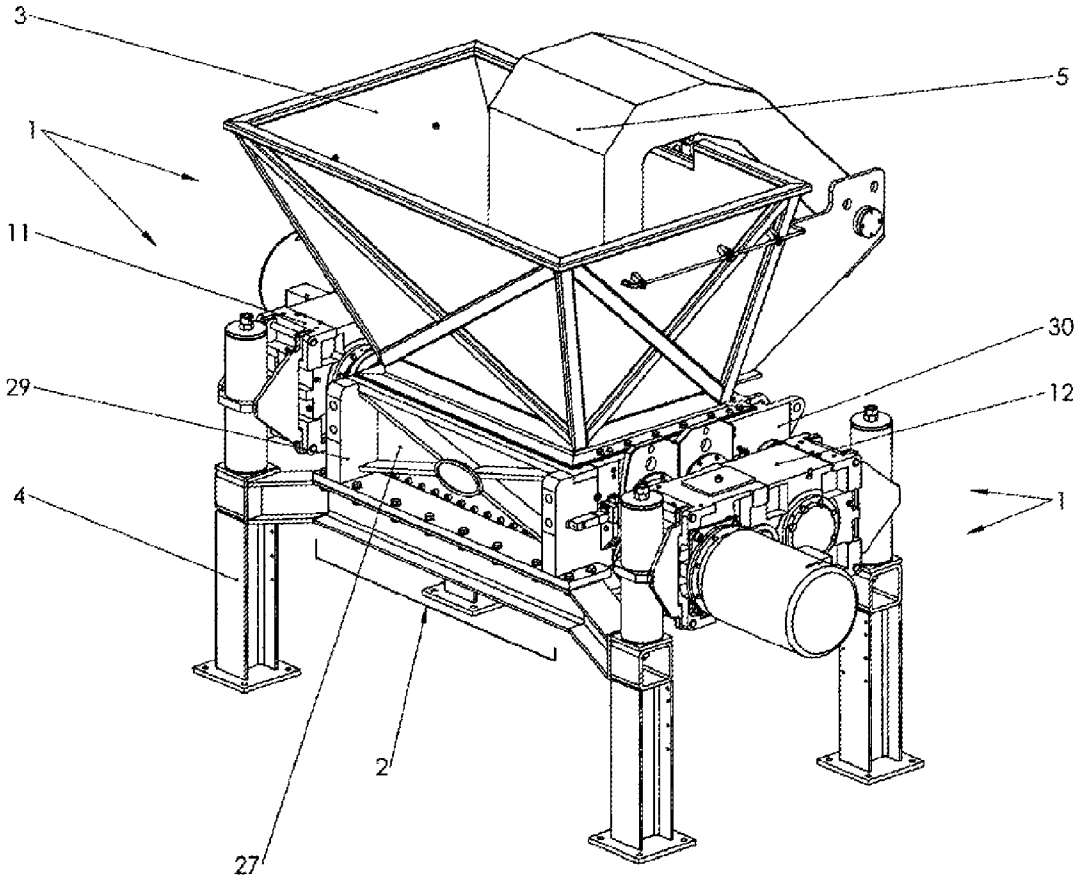
FIG. 1 is a diagrammatic perspective view of a disintegrating machine according to the invention in an operating state.

Referring now to the figures of the drawings in detail and first, particularly to FIG. 1 thereof, there is shown a disintegrating machine according to the invention, in particular a rotary cutter or rotary tearing device, which generally includes a driving device 1, a disintegrating device 2 and a hopper 3 which is fitted on the disintegrating device 2, optionally with a follow-up pressing device 5. The driving device 1 and the disintegrating device 2 are preferably fitted on a mount 4.

The driving device 1 contains a first drive 11 and a second drive 12. The drives are of substantially structurally identical design, and therefore only one drive will be described in more detail below. The drive can comprise, for example, an electric motor 13 with a transmission 14 connected downstream (see FIG. 2). A power of more than 30 kW is preferably provided per drive. In a preferred embodiment, each drive has 95 kW.

Figure 4:
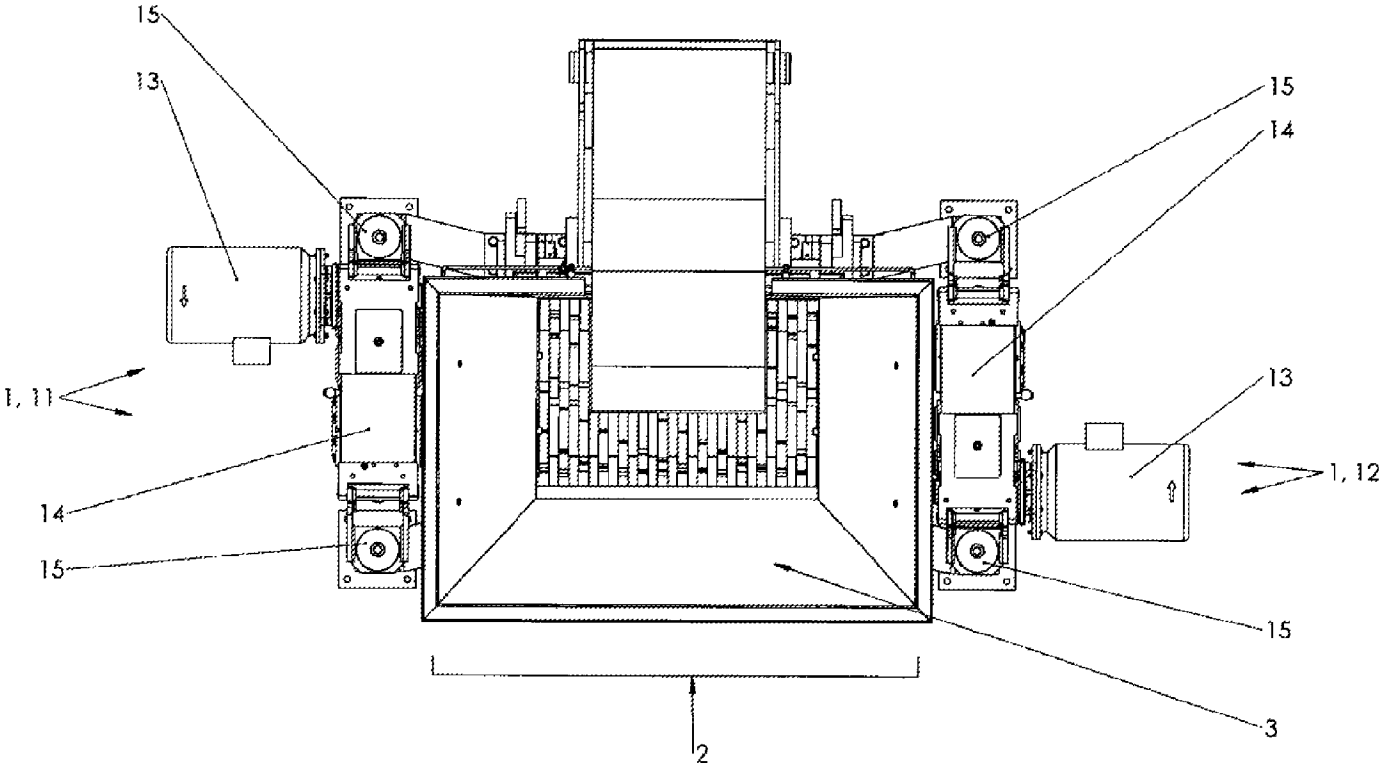
FIG. 4 is a top plan view of the disintegrating machine according to the invention in the operating state.

The driving device 1, in particular the drive 11, 12, is preferably fitted on the mount 4 by spring and/or damping elements 15 (see FIG. 4). The spring and/or damping element may be, for example, a rubber spring.

Figure 2:
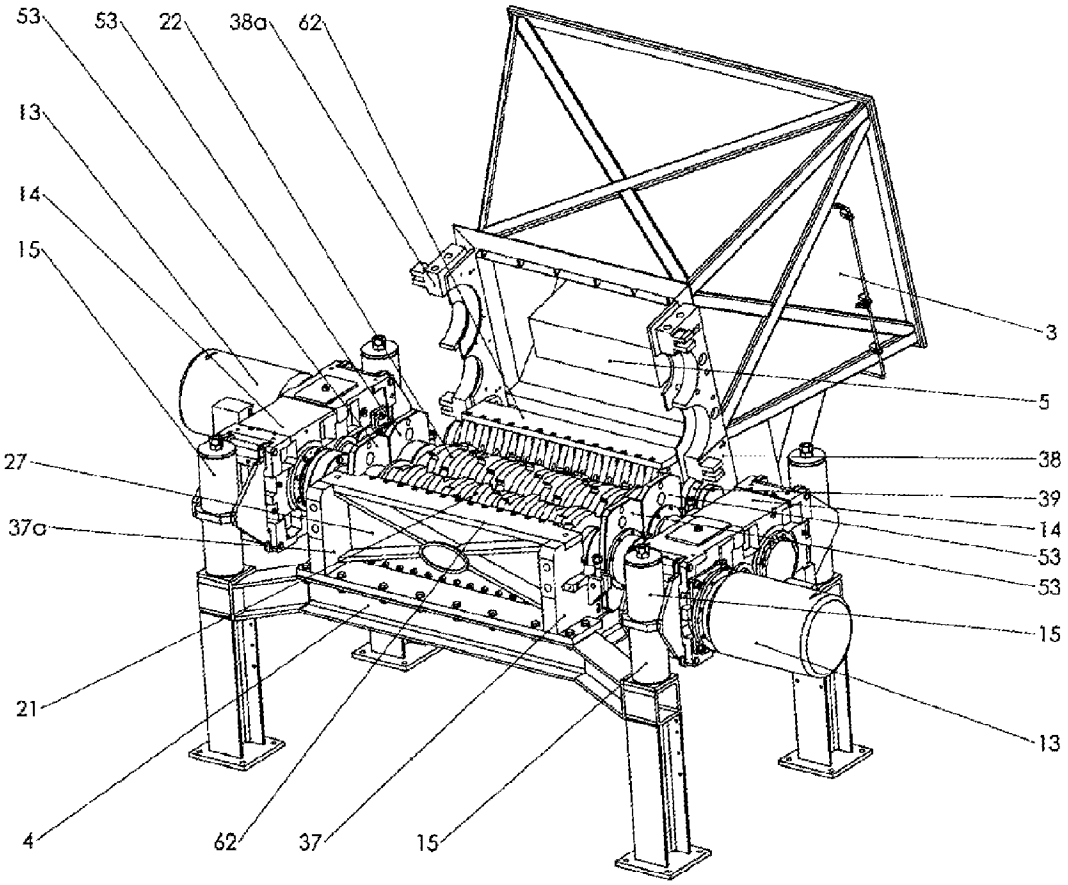
FIG. 2 is a diagrammatic perspective view of the disintegrating machine according to the invention in a maintenance state with bridges merely pivoted upward and a tilted hopper.
Figure 13:
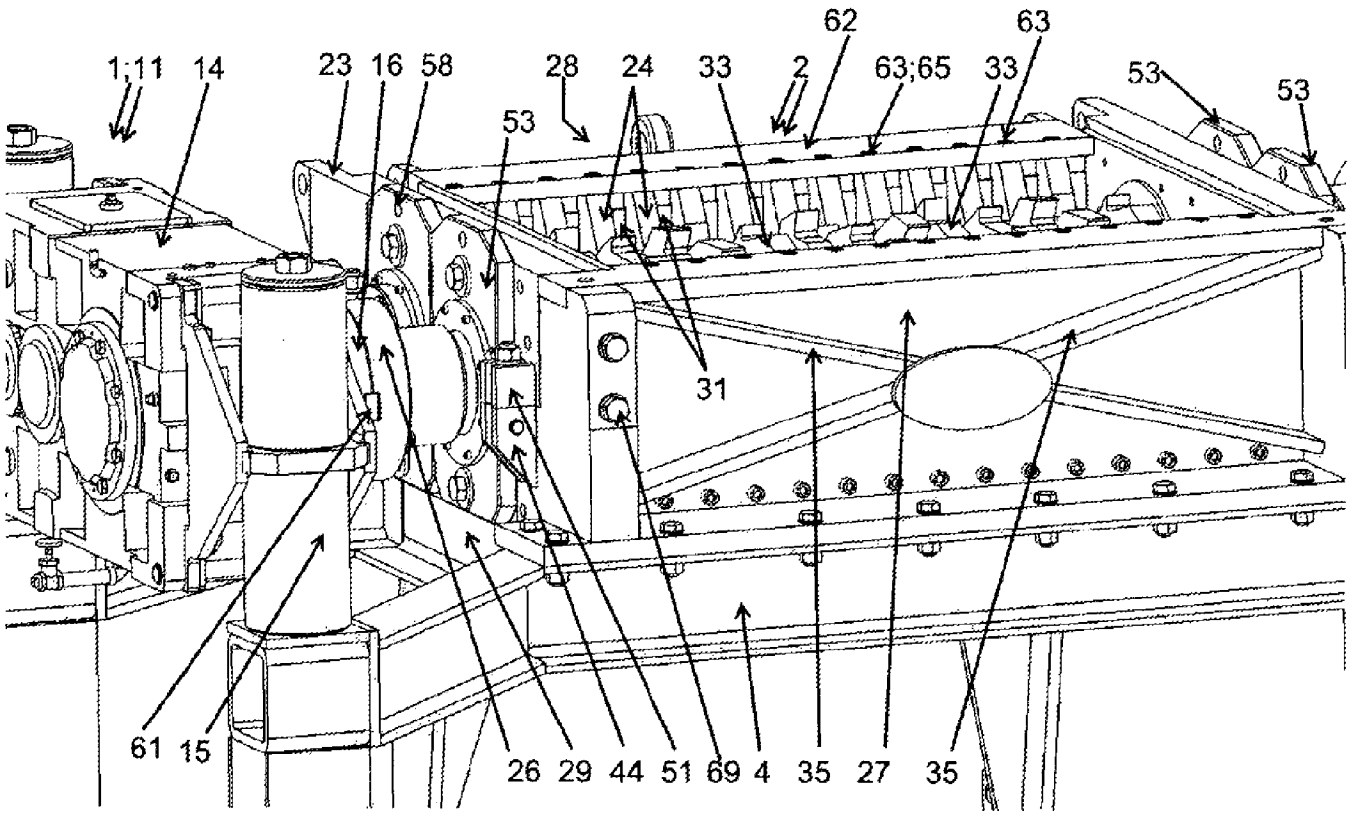
FIG. 13 is a perspective view of the disintegrating machine according to the invention.
Figure 14:
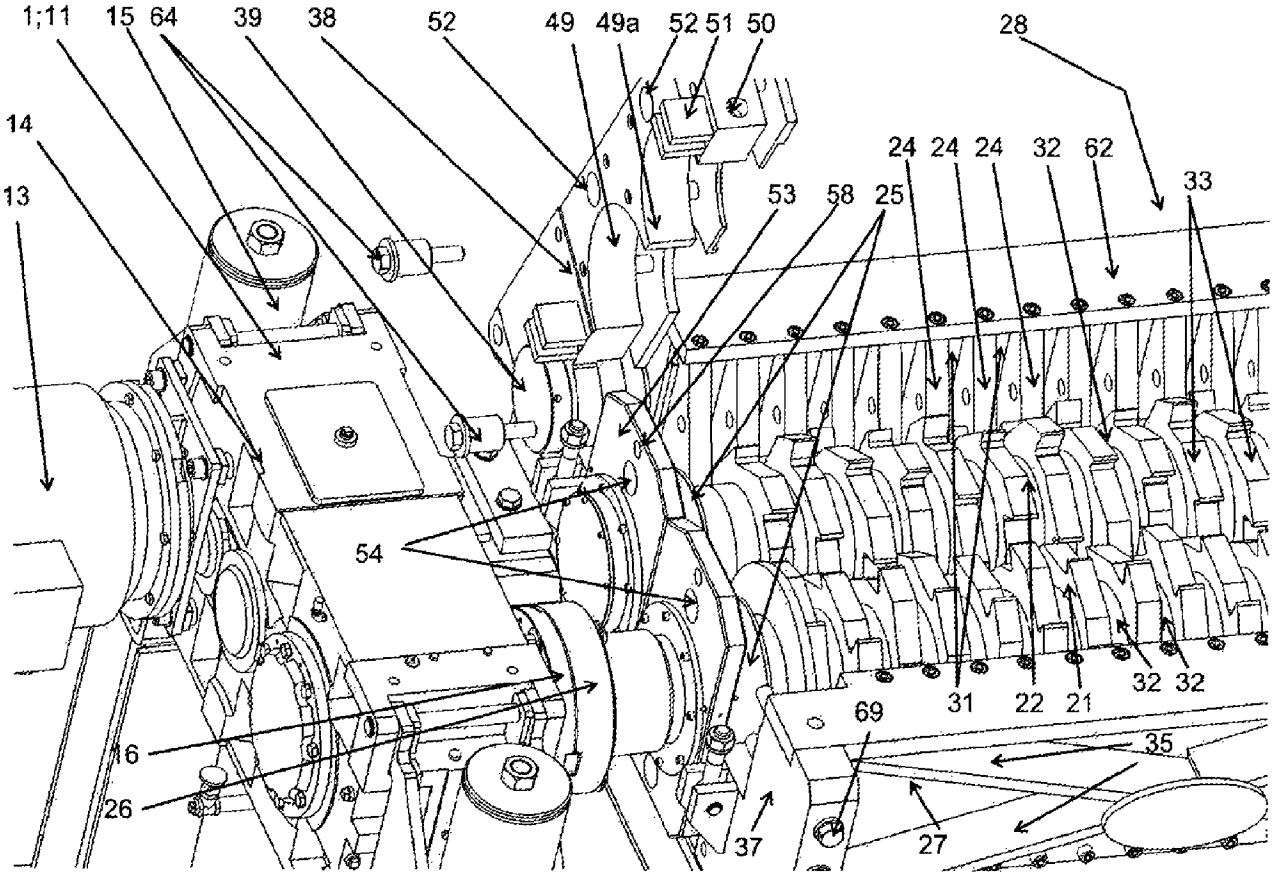
FIG. 14 is a perspective view of the disintegrating machine according to the invention.

As shown in FIGS. 2 and 13, the disintegrating device 2 generally contains a first knife shaft 21, a second knife shaft 22, a frame 23, a number of scrapers 24, bearings 25 for the knife shafts 21, 22 and bearing receptacles for the knife shafts or for the bearings 25 of the knife shafts 21, 22.

Depending on the embodiment of the disintegrating machine as a rotary cutter or a rotary tearing device, the knife shafts 21, 22 can be correspondingly configured as a cutter shaft or tearing device shaft.

The two cutter shafts 21, 22 together are also called a set of cutting shafts. The two tearing device shafts are also referred to as a set of tearing device shafts.

Figure 1A:
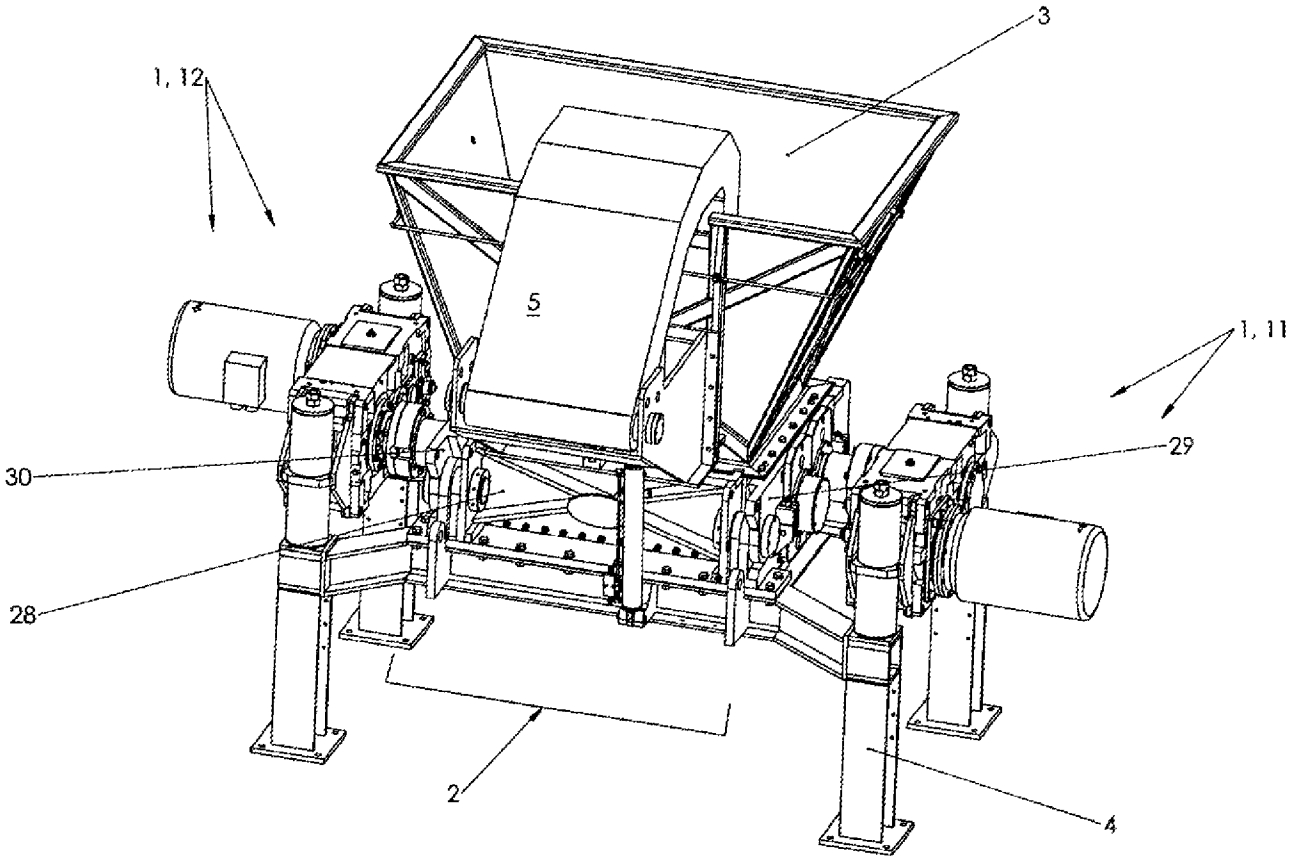
FIG. 1A is a diagrammatic perspective view of the disintegrating machine according to the invention in the operating state.
Figure 4A:
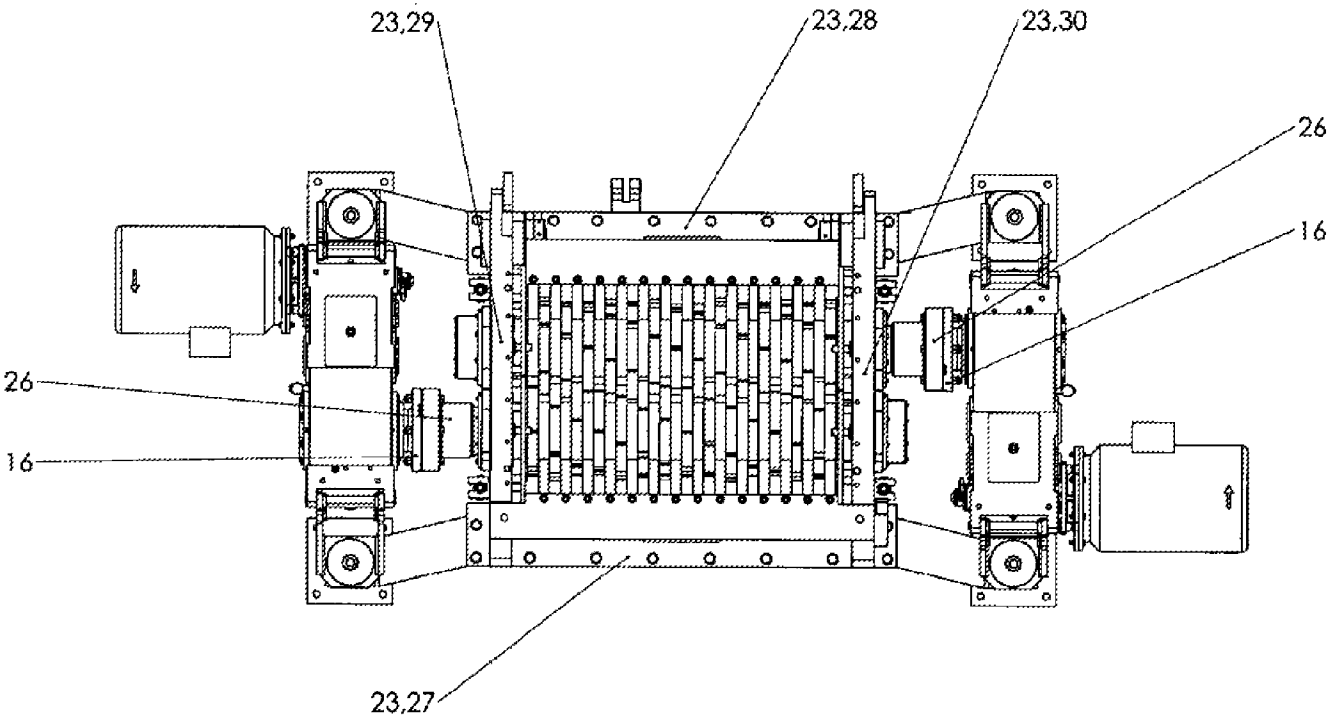
FIG. 4A is a top plan view of the disintegrating machine according to the invention in the operating state in a view without the hopper.

As shown in FIGS. 1A and 4A, the frame 23 has a first side wall 27, a second side wall 28, a first end wall 29 and a second end wall 30. The side walls 27, 28 and the end walls 28, 29 form a rectangular frame in a top view. The scrapers 24 which protrude into the frame 23 perpendicularly from the side walls 27, 28 are fitted along the frame 23, in particular along the side walls 27, 28 of the frame. The individual scrapers 24 of a side wall have a distance therebetween in the longitudinal direction such that distance spaces 31 arise between the scrapers 24.

Figure 5:
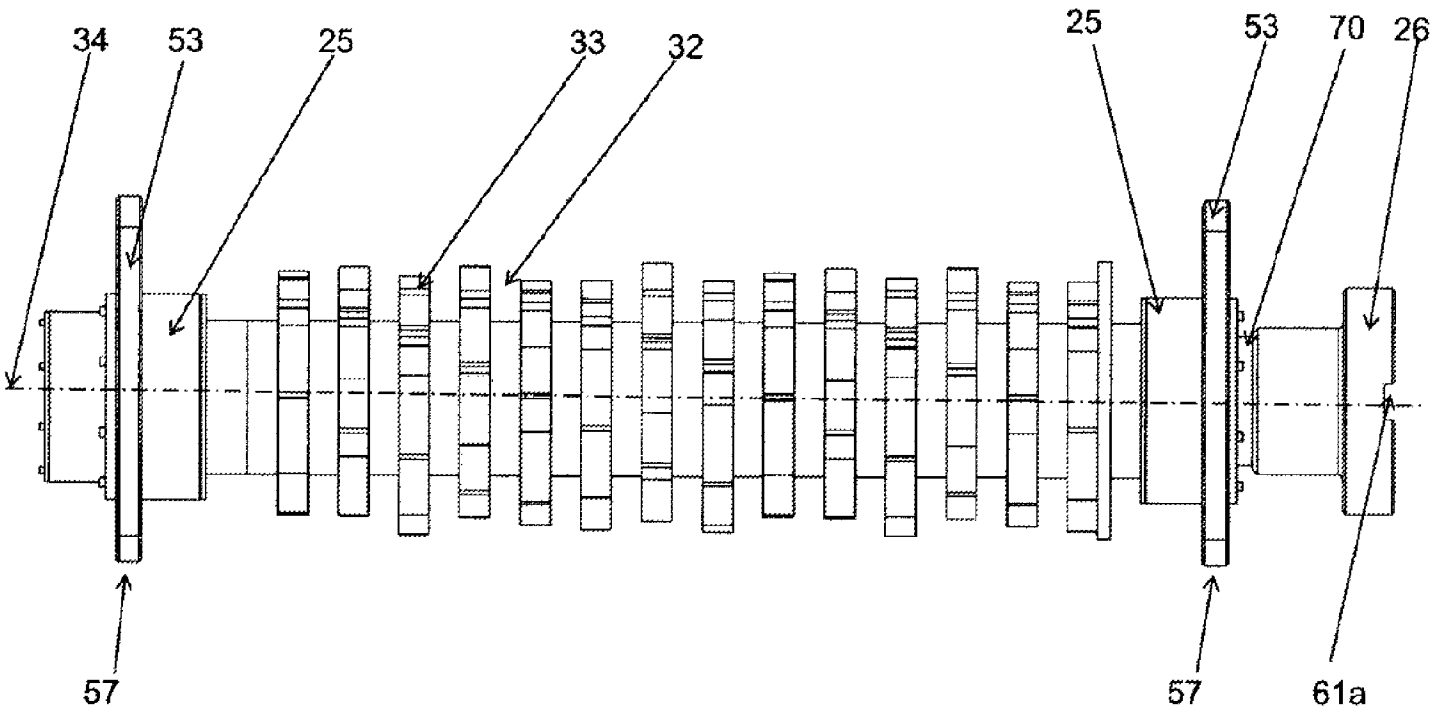
FIG. 5 is a side view of a knife shaft with bearing plates.
Figure 6:
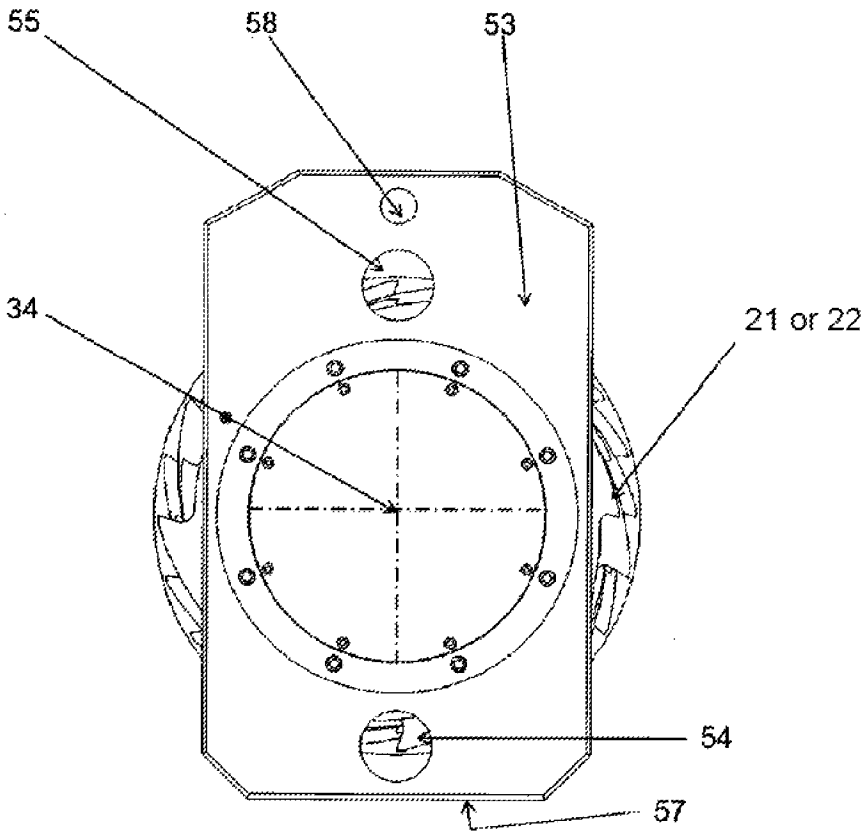
FIG. 6 is a front view of the knife shaft with the bearing plates.

A knife shaft 21, 22 has a shaft 70, a number of knife disks 33 and a number of distance bushings 32 (see FIG. 5). The knife disks 33 are configured as elevations in relation to the shaft, the elevations revolving around the shaft and being provided on the circumferential side with draw-in hooks. In other words, wider disks similar to circular saw blades are fitted at axial distances on the shaft. Distance bushings 32 are provided between the knife disks 33. The knife shaft 21, 22 has an axis of rotation 34. The knife disks 33 have a larger radius with respect to the axis of rotation 34 than the shaft 70 and the distance bushings 32. The knife shaft 21, 22 can be configured as a single part, that is from one piece, but can also be configured in multi-part form.

At least two knife shafts, that is the first knife shaft 21 and the second knife shaft 22, are accommodated rotatably in the disintegrating machine, in particular in the frame 23. The knife shafts 21, 22 and the axis of rotation 34 of the knife shafts run parallel to the side walls 27, 28 of the frame here. The first knife shaft 21 here faces the first side wall 27, and the knife disks 33 of the first knife shaft 21 run through the distance spaces 31 of the scrapers 24 of the first side wall 27. The second knife shaft 22 faces the second side wall 28, and the knife disks 33 of the second knife shaft 22 run through the distance spaces 31 of the scrapers 24 of the second side wall 28. Furthermore, the knife disks 33 of the first knife shaft 21 run through the distance spaces of the second knife shaft 22 and the knife disks 33 of the second knife shaft 22 run through the distance spaces of the first knife shaft 21.

With regard to the knife shafts and the knife disks, an embodiment of the disintegrating machine as a rotary cutter is distinguished in comparison to the embodiment as a rotary tearing device in particular in that the knife disks converge more closely or at a greater distance, thus resulting in different disintegrating mechanisms. In particular by the greater distance of the knife cutters in the embodiment as a rotary tearing device, the recyclable materials are substantially torn and cut less than is the case in the rotary cutter, in which the knife disks tend to converge at a smaller distance to one another. The process in the case of the embodiment of the rotary tearing device means that the throughput rate is generally higher than in the case of the embodiment of the rotary cutter.

Figure 3:
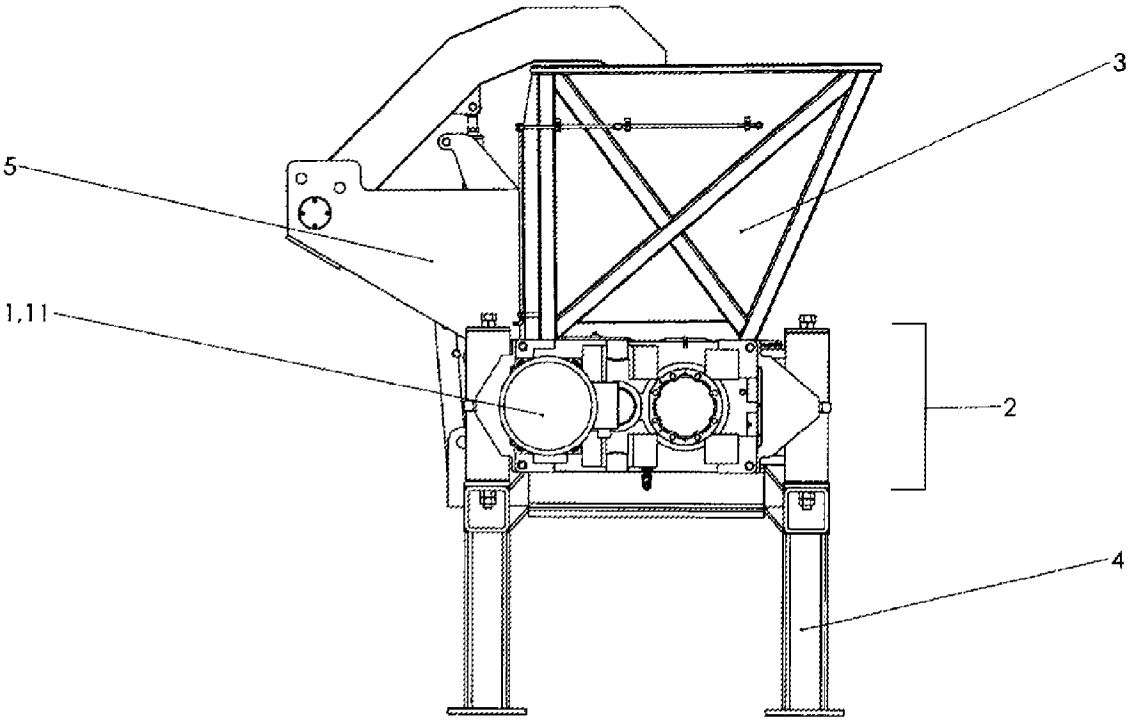
FIG. 3 is a side view of the disintegrating machine according to the invention in the operating state.

In a customary position of use or operating state, the hopper 3 is fitted above the disintegrating device 2 (see FIG. 3). However, the hopper 3 can also be pivoted into a maintenance position or maintenance state. This will be discussed in further detail further below.

The disintegrating machine functions as follows. The first knife shaft 21 is set into rotation by the first drive 11 and the second knife shaft 22 is set into rotation by the second drive 12. Preferably, for this purpose, the first drive 11 is fitted on one side of the frame 23 and the second drive 12 is fitted on the other side of the frame 23. In the normal operating state, the direction of rotation of the two knife shafts 21, 22 is preferably directed toward the center of the machine.

Recyclable materials, such as, for example, coated copper cables, tires, etc., can now be thrown into the hopper 3. The recyclable materials are disintegrated and partially split into their component parts by the disintegrating device, in particular between the knife shafts 21, 22 and the scrapers 24. The disintegrated recoverable materials drop out of the disintegrating device 2, for example into a non-illustrated collecting container which is positioned under the disintegrating device supported on a mount 4.

The disintegrating machine proposed here is distinguished in particular by particularly advantageous properties.

In principle, it is required to construct the disintegrating machine to be as lightweight as possible. On the other hand, considerable forces act on the disintegrating machine during the disintegration of the recoverable materials, and therefore a correspondingly large amount of material which is stable, but unfortunately also heavy, has to be used. Basically, however, a suitable material is steel.

Figure 8:
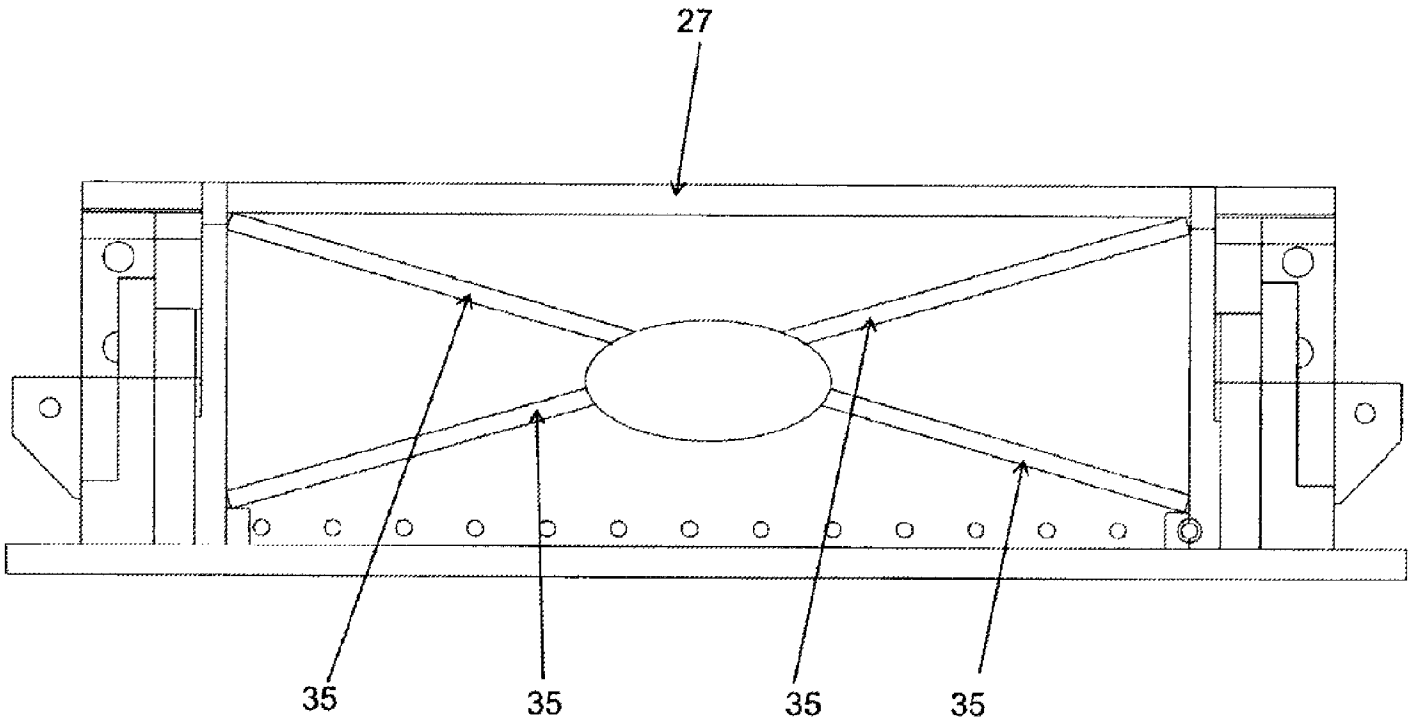
FIG. 8 is a front view of the main body together with a side wall.

Against this background, it is proposed to equip the frame 23 or at least an element of the frame 23, preferably at least one wall, in particular both side walls 27, 28, with reinforcing ribs 35 (see FIG. 8). If the starting point is, for example, a rectangular design of the side wall 27, 28, the reinforcing ribs 35 preferably run diagonally, in particular from one corner to the opposite corner. The reinforcing ribs 35 are preferably elongate and flat profiles which lie in particular vertically on the surface of the side wall. The reinforcing ribs can be formed as a single part with the side wall, but also as separate elements. In the embodiment as separate elements, the reinforcing ribs are correspondingly fixed on the end side in the corners. In a top view of the side wall, an X-shaped configuration of the reinforcing ribs 35 is preferably produced.

The walls of the hopper 3 can also be equipped with reinforcing ribs 35 of this type.

By the reinforcing ribs 35, it is possible for the construction to be lighter in weight with the same or even greater stability of the disintegrating machine, for example, given an identical anticipated load, the side wall 27, 28 can be configured to be thinner or of a different material than it would have to be for an anticipated load without reinforcing ribs.

Furthermore, it is required to configure the disintegrating machine to be as easy to maintain as possible, in particular to permit rapid and unproblematic maintenance or repair. For this purpose, the disintegrating machine has a number of advantageous and inventive technical devices.

First of all, the connection of the driving device, in particular of the drives 11, 12, to the knife shafts 21, 22 should be mentioned here, the connection preferably taking place by a quick change coupling. The connection between the first drive 11 and the first knife shaft 21 is described below. The connection of second drive 12 to the second knife shaft 22 takes place in an identical manner.

Figure 16:
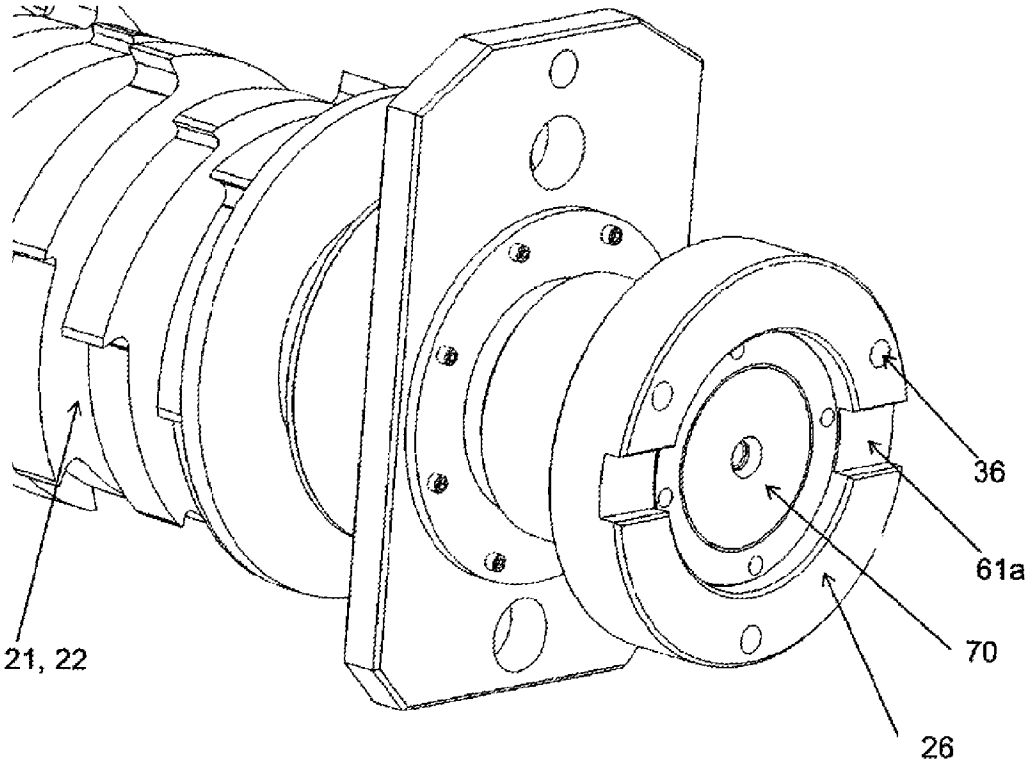
FIG. 16 is a perspective view of a flange of a driving device or driving means.
Figure 17:
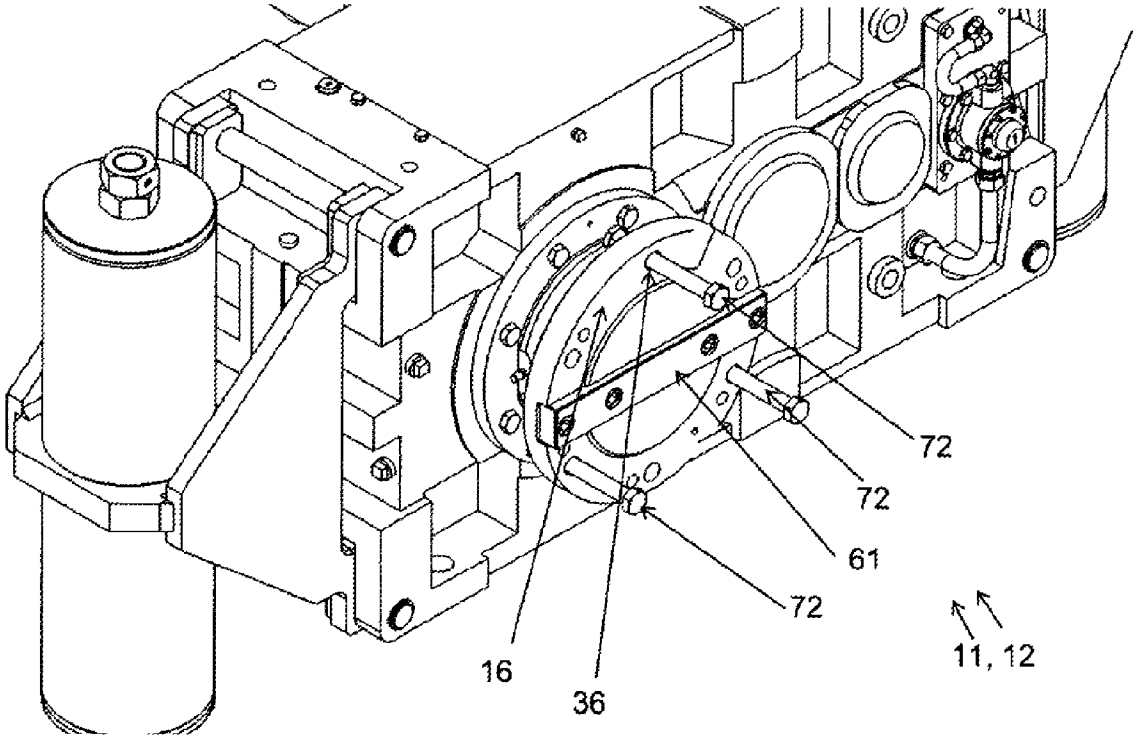
FIG. 17 is a perspective view of the flange of the knife shaft.

The quick change coupling contains a first flange 16 and a second flange 26 (see FIG. 13). The first flange 16 is connected to the respective drive 11, 12 and the second flange 26 is connected to the associated knife shaft 21, 22. Both the first flange 16 and the second flange 26 merely have three bores 36 each (see FIG. 16). In the mounted state, the bores 36 of the first flange 16 and the second flange 26 are aligned, and therefore screws 72 can be passed therethrough. The screws are fixed by nuts. Furthermore, only one carrier 61 is provided between the flanges 16, 26 (see FIG. 17). The carrier 61 which is fastened to the one flange is accommodated in a clearance 61*a* of the other flange, the clearance being introduced in the flange in each case in the radial direction. During the changing of the shafts, the carrier 61 does not have to be removed. The quick change coupling with only one fixedly mounted carrier 61 facilitates the removal of the shafts by release of only three screws 72 per coupling.

Furthermore, the configuration of the bearing receptacles for the knife shafts should be mentioned in conjunction with advantageous maintenance. With regard to the arrangement already described above of the knife shafts in the frame, the bearing receptacles are provided in the end walls 29, 30 or the bearing receptacles are formed by the end walls. Since the bearing receptacles are of substantially identical construction, reference will essentially be made below to one bearing receptacle.

The knife shafts 21, 22 are basically mounted in the frame 23 by rolling contact bearings, for example by ball bearings or roller bearings. However, other types of bearings, for example plain bearings, are also suitable. The bearings 25 sit on the end side of the knife shafts 21, 22. If the bearing 25 has an outer ring and an inner ring, the inner ring is connected to the knife shaft and the outer ring is connected to the frame 23 by the bearing receptacle, optionally with the interconnection of a further bearing ring 71 (see FIG. 12).

Figure 7:
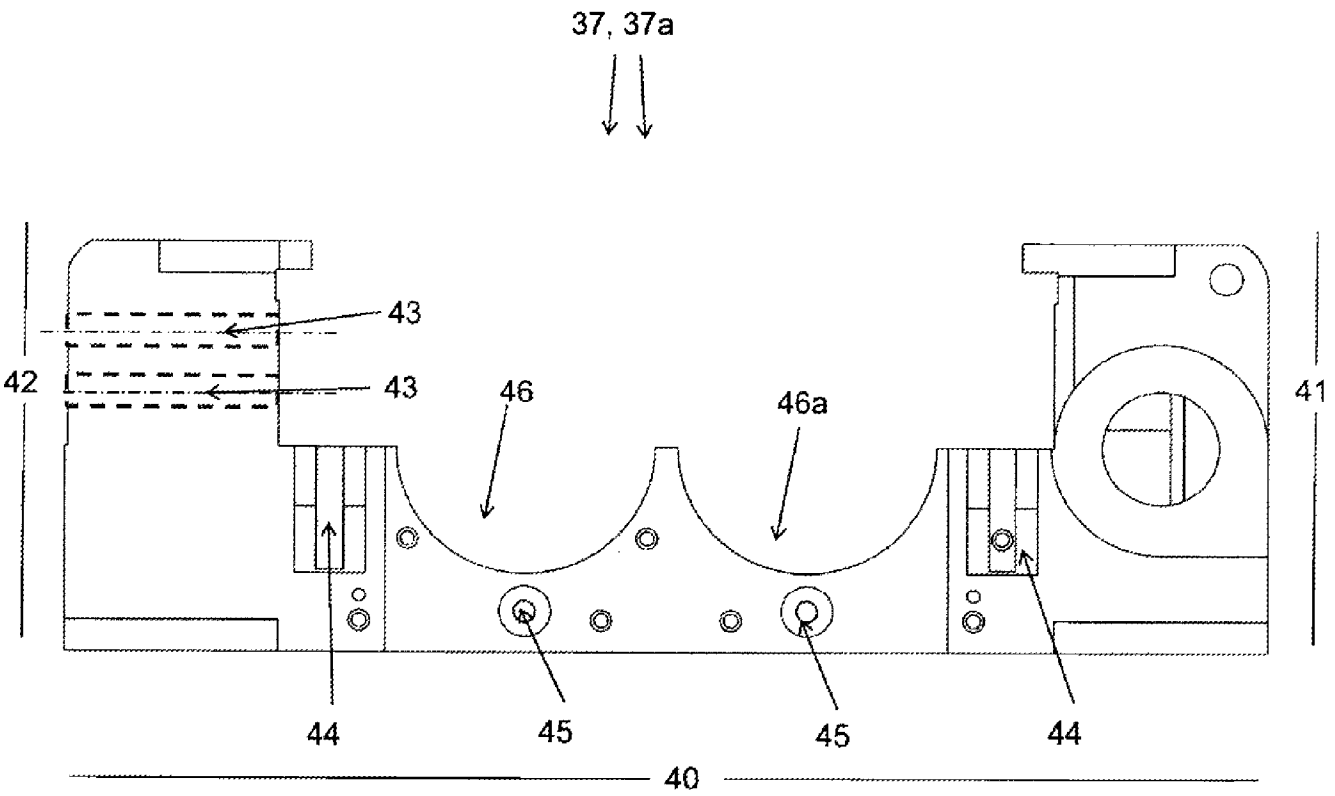
FIG. 7 is a side view of a main body.
Figure 9:
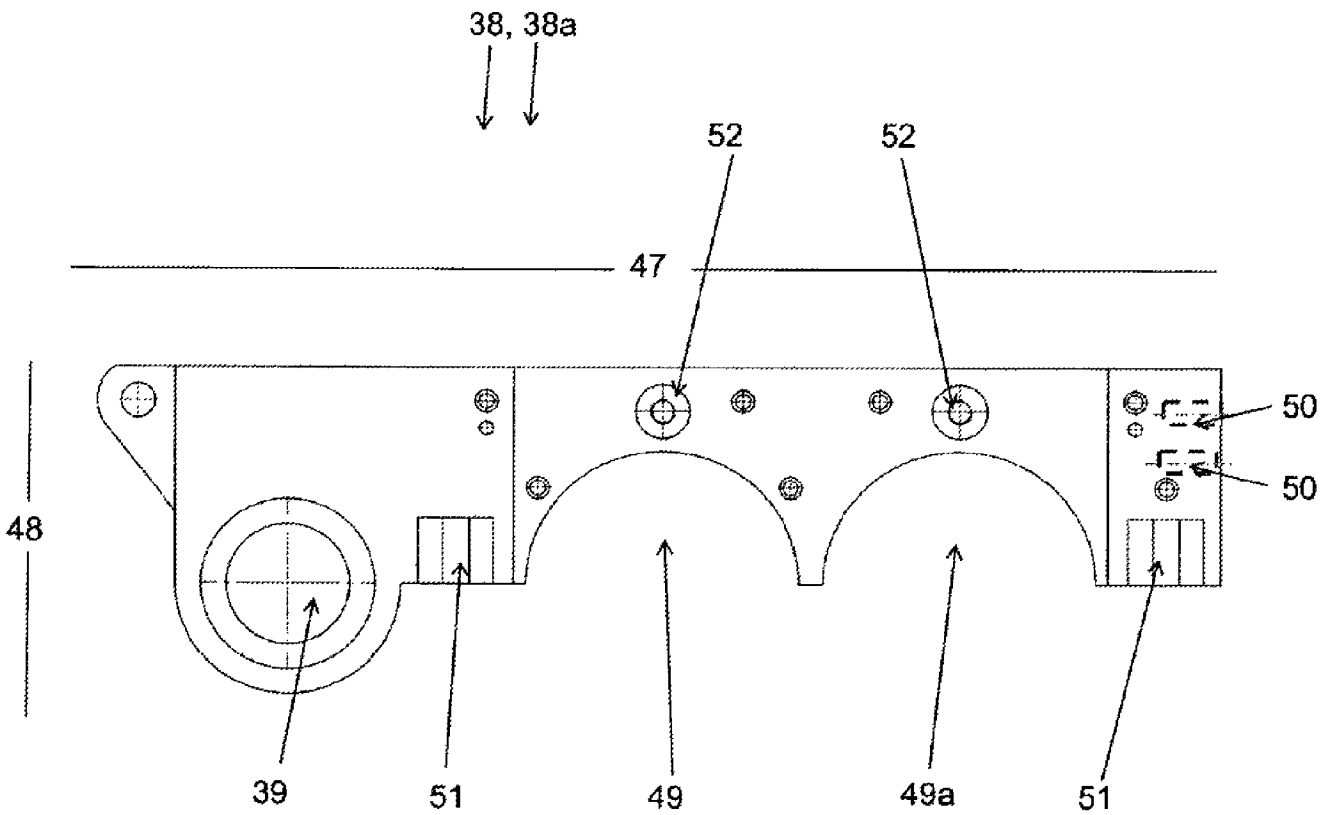
FIG. 9 is a side view of a bridge.
Figure 10:
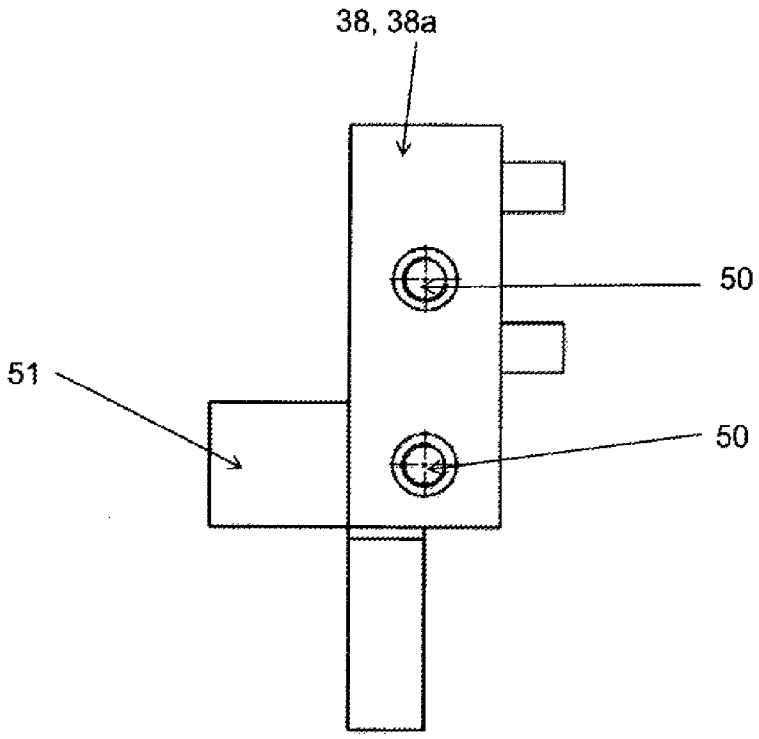
FIG. 10 is a front view of the bridge.

The bearing receptacle has a main body 37 and a bridge 38 (see FIGS. 7 and 9), and also in particular a play-free or at least play-reduced bearing 39 and a releasable fixing device. Since, preferably, two bearing receptacles are provided on the two sides of the frame, the further main body and bridge, that are constructionally identical per se, will be denoted by the reference numbers 37*a* and 38*a*, respectively. However, for the sake of clarity, reference is merely made to a combination of main body 37 and bridge 38.

The main body 37 is of substantially U-shaped configuration from a side view and correspondingly has a longitudinal side 40, a first limb 41 and a second limb 42. The main body 37 can also be of L-shaped configuration or can also have entirely different shapes. The main body is preferably of elongate design. Furthermore, the main body 37 has a first semicircular recess 46 and a second semicircular recess 46*a* in its longitudinal side 40. In its second limb 42, the main body 37 preferably has two bores 43 which run parallel to the longitudinal side 40 of the main body. Furthermore, the main body preferably has two brackets 44 with threaded rods accommodated pivotably therein. The main body 37 also preferably has two threaded bores 45 in its longitudinal side 40, the threaded bores being provided perpendicularly to the longitudinal side.

The bridge 38 is of a substantially L-shaped configuration in a side view and has a longitudinal side 47 and a limb 48. Other shapes are also conceivable here. The bridge is preferably of an elongate configuration. Furthermore, the bridge 38 preferably has a first semicircular recess 49 and a second semicircular recess 49*a* in its longitudinal side 47. The longitudinal side 47 of the bridge 38 has, on the end wall thereof, two threaded bores 50 which run substantially parallel to the longitudinal side 47 of the bridge 38. The bridge 38 preferably also has two receptacles 51 into which the threaded rods 44 of the brackets on the main body side can be pivoted. In addition, the bridge 38, in its longitudinal side 47, preferably has two threaded bores 52 which are provided perpendicularly to the longitudinal side 47.

The bridge 38 is connected pivotably to the main body 37 via the play-free/play-reduced bearing 39. The bearing 39 is preferably installed in the first limb 41 of the main body 37 and in the limb 48 of the bridge 38. The bearing 39 is preferably installed in such a manner that the pivot axis of the bearing runs perpendicularly to the longitudinal axes of main body 37 and bridge 38. If main body 37 and the bridge 38 span an imaginary plane, the axis of rotation of the bearing is preferably perpendicular to the plane.

The play-reduced, preferably play-free, bearing 39 is distinguished in particular by the following features. The bearing 39 is produced from a composite material. The composite material is extremely hard and is nevertheless resistant to momentum forces. This results in a play-reduced, preferably play-free, mounting of the bridge 38, which, in turn, permits a flow of forces directly into the frame. In addition, the bearing 39 is preferably maintenance-free. The bearing play is preferably 0.02 mm or less.

As already indicated above, bearing receptacles are provided on both sides of the frame 23, and the end walls of the frame are preferably formed, at least in sections, from the bearing receptacles, in particular from the bridge in the main body in each case. In this respect, in a folded up state, the bridge 38 and the main body 37 have approximately the shape of a rectangular wall. The shape which the bridge and the main body have specifically is also essentially insignificant in this respect as long as, in a joined together state, the bridge and the main body can be joined together to form a suitable end wall or a part thereof.

It can furthermore be provided that the hopper 3 is mounted on at least one bridge 38 and 38*a*, preferably on the bridges 38 and 38*a*. It can thereby be made possible for the hopper 3, including an optionally mounted follow-up pressing device 5, to be able to be pivoted with the bridges 38, 38*a*. By this measure, to a certain extent in one working step, the hopper 3 and the optionally mounted follow-up pressing device 5 can be pivoted to the side and the knife shafts 21, 22 can be exposed for removal. After repair of the knife shafts or the insertion of new or other knife shafts, the bridges 38, 38*a* can be folded back again, as a result of which, first, the hopper and the optionally mounted follow-up pressing device 5 can be pivoted again into an operating position and, second, the bearing receptacle can be closed again.

Figure 18:
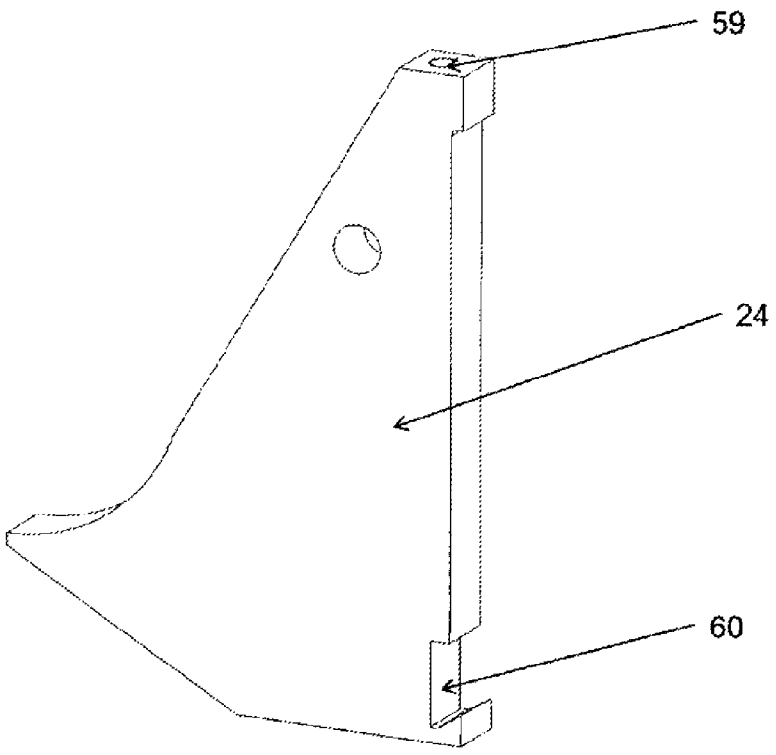
FIG. 18 is a perspective view of a scraper.
Figure 19:
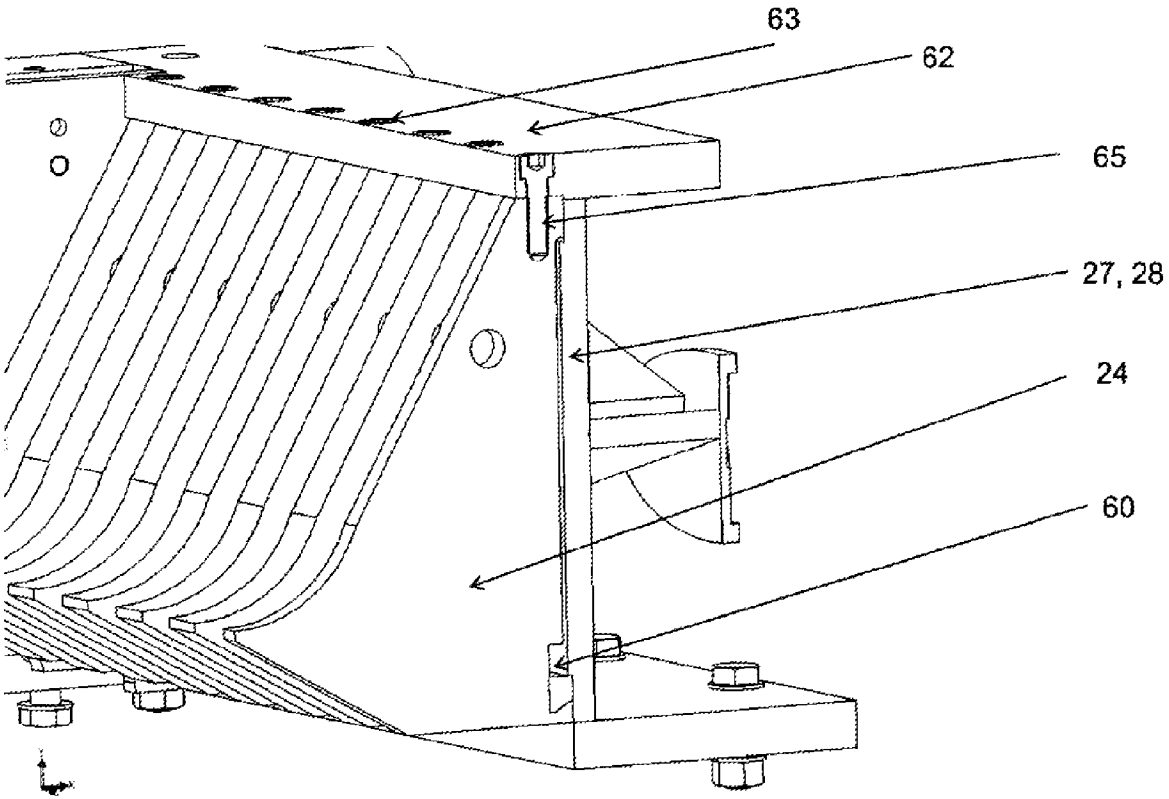
FIG. 19 is a perspective view of the a scraper in an installed situation.
Figure 20:
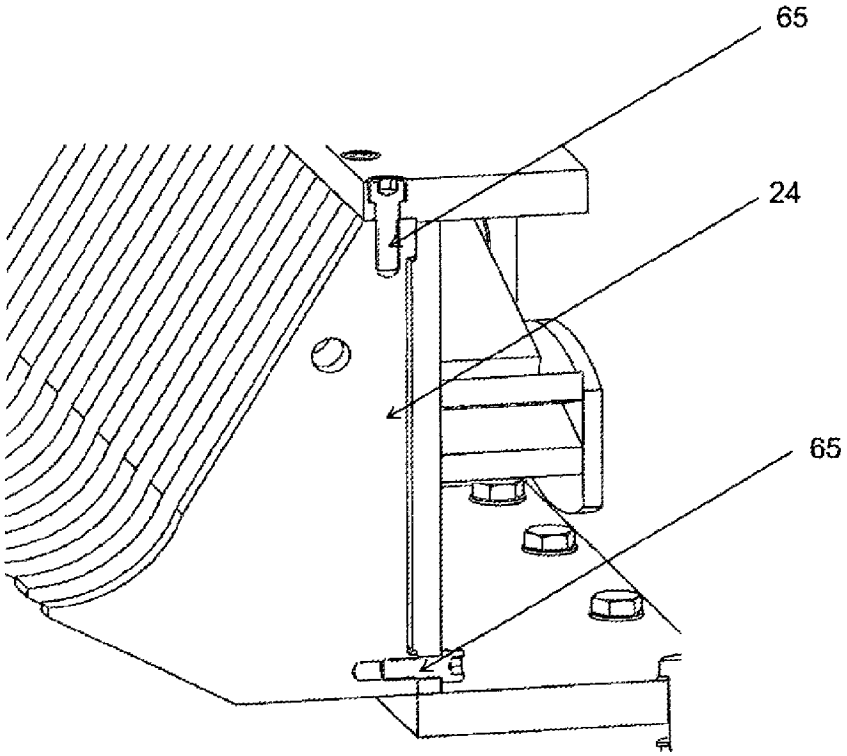
FIG. 20 is a perspective view of the scraper with two screws.
Figure 21:
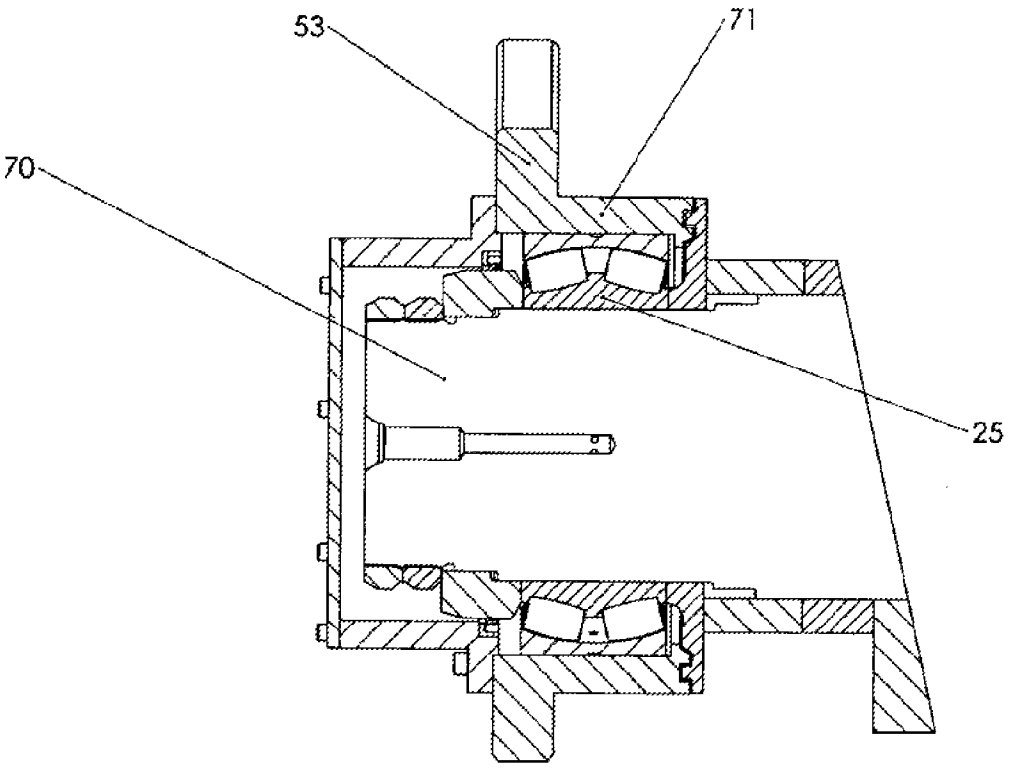
FIG. 21 is a sectional view through a preferred refinement of a receptacle of a bearing of the knife shaft with a bearing ring.

Furthermore, the design of the fastening of the scrapers 24 should be mentioned in conjunction with advantageous maintenance (see FIGS. 18-20). The scraper 24 preferably has only one threaded bore 59 and a hook 60 for fastening to the respective side wall 27, 28. The threaded bore 59 here is preferably oriented in the longitudinal direction of the scraper 24 and provided at one end of the scraper. The hook 60 is fitted in the region of the other end of the scraper 24. A strip 62 with a number of bores 63, through which screws 65 can be correspondingly screwed, is arranged along the upper side of the side wall. Furthermore, a counterpart to the hooks 60 of the scrapers 24 is fitted along the lower region of the side wall 27, 28. The scraper 24 can advantageously be released by just one screw. However, a further variant of the fastening of the scraper 24, for example by two screws, of which one from above and one from the side, is also conceivable.

Figure 11:
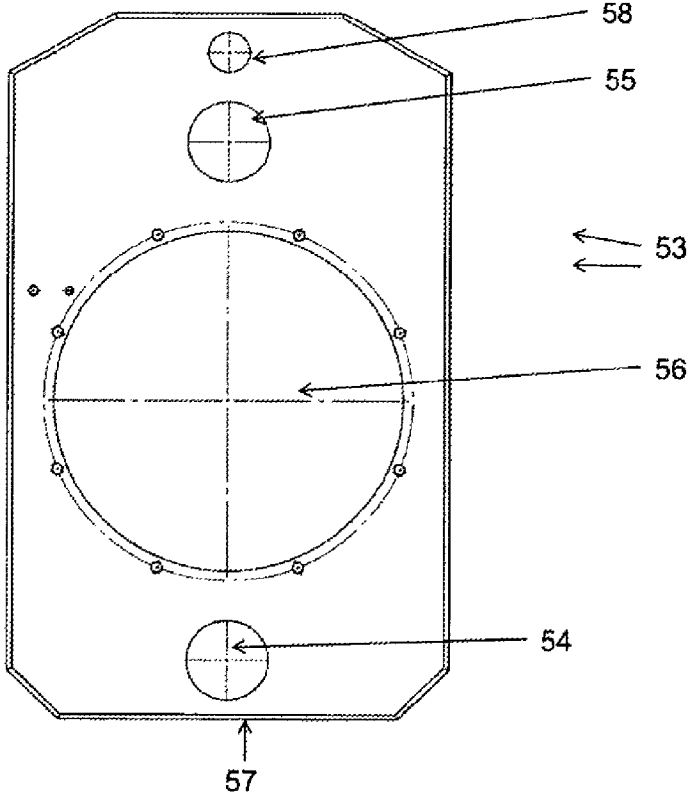
FIG. 11 is a front view of a bearing plate.

Furthermore, the configuration of the bearing plates 53 should be mentioned in conjunction with advantageous maintenance (see FIG. 11).

The bearing plate 53 is preferably of approximately rectangular construction, preferably a rectangular configuration. The bearing plate preferably has a shaft lead-through 56, for example a circular recess, from which in each case one section of the bearing plate extends in the one direction and the other section extends in the other direction. The shaft lead-through can be covered by a cover even if, for example, only a very short section of the shaft has been led therethrough. Two bearing plates 53 are preferably installed per knife shaft, in particular in each case on the end side of the knife shaft. With respect to the longitudinal axis or axis of rotation of the knife shaft, the sections of the bearing plate 53 in each case extend radially from the longitudinal axis or axis of rotation of the knife shaft.

The bearing plate 53 can preferably carry out a plurality of functions, in particular four functions.

The bearing plate can act as a connecting element between the main body 37 and the bridge 38. For this purpose, it can be provided that the bearing plate 53 is equipped with a connecting device, in particular bores, preferably bolt lead-throughs 54, 55, for the releasable connection both to the bridge and to the main body.

The bearing plate 53 can act as a stand for the knife shaft 21, 22 connected thereto, if the knife shaft is placed on the ground, for example after removal or for the mounting.

For the function as a stand, the bearing plate 53 can have at least one standing foot 57 which preferably, with respect to the axis of rotation 34 of the knife shaft 21, 22, is at a greater distance from the axis of rotation, in the fitted state on the knife shaft, than the largest radius of the knife shaft. In a simple embodiment, the border of the bearing plate 53 in the fitted state protrudes beyond the largest radius of the knife shaft 21 or 22. A bearing plate 53 of this type is preferably fitted on each side of the knife shaft 21, 22, and therefore the knife shaft, when deposited on the ground, can stand on the standing feet 57 of the bearing plates 53, and the cutters of the knife disks do not have to rest on the ground. This protects the teeth of the knife disks.

Furthermore, the bearing plate 53 can be provided with an opening 58 for the hooking-in of a crane hook or basically for the connection to a crane.

Figure 12:
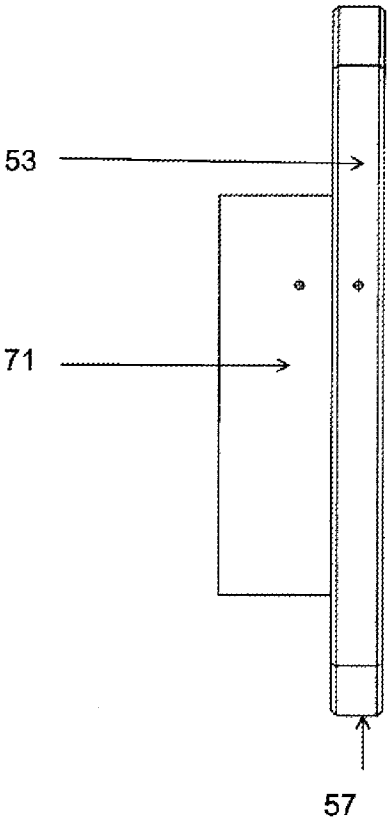
FIG. 12 is a side view of the bearing plate.

In addition, the bearing plate 53 can also act as a bearing connection of the shaft mounting. For this purpose, the bearing plate can have a connection for the bearing 25, in particular the outer ring of the bearing 25. The connection can be configured, for example, as a bearing ring 71 (FIG. 12). The bearing ring 71 and the bearing plate 53 can be configured as a single part, but the bearing ring can also be configured as a separate part and be connected in particular to the bearing plate. The connection, in particular the bearing ring 71, is configured for receiving the bearing 25, i.e. in particular the outer ring of the bearing 25. In a preferred embodiment of the disintegrating machine, the bearings 25 of the knife shaft are accommodated via the bearing ring 71 in the bearing receptacle, which is between bridge 38 and main body 37.

The bearing plate 53 can therefore preferably have a plurality of functions, in particular four functions, and can in this respect be referred to as multifunctional. First a bearing shell function, second as a stiffening element and connecting element between bridge and main body, wherein the bearing plate can therefore be part of the frame. Thirdly as a depositing frame with protection of the knife disks. Fourthly as a hoisting device bore/receptacle for transport and shaft support.

Further details of the proposed disintegrating machine emerge from a description of maintenance of the disintegrating machine according to the invention.

In a customary operating state, the knife shafts 21, 22 are accommodated in the frame 23 and in the corresponding bearing receptacles by the bearings 25. The respective semicircular recesses 46*a*, 46*b*, 49*a*, 49*b* complement one another to form a full circle and hold the respective bearing 25 or the outer ring or bearing ring of the respective bearing. The bridge 38 is fixed to the main body 37 and secured against swinging up via the fixing device. The main body 37*a* and the bridge 38*a* substantially complement each other to form a rectangular wall and to a certain extent form the first end wall 29, and the main body 37 and the bridge 38 form the second end wall 30 of the frame.

The fixing device can contain, for example, the two bores 43 in the second limb 42 of the main body 37, the two threaded bores 50 in the longitudinal side 47 or of the end side of the longitudinal side of the bridge 38 and two screws 69. The abovementioned bores and the associated threaded bores are aligned in an operating state, and the screws 69 are screwed through the bores 43 into the threaded bores 50.

The fixing device can contain, for example, the two brackets 44 with the pivotable threaded rods on the main body and the two receptacles 51 on the bridge 38. The threaded rods 44 are retracted into the receptacles 51 of the bridge 38, and the brackets are connected to one another via nuts or, by tightening the nuts, the brackets can be drawn to one another and the bridge can be correspondingly pressed onto the main body. The brackets are configured approximately as two parallel, rectangular profiles.

The fixing device can contain, for example, the two bearing plates 53 with the bores 54, 55 for the threaded bolts, the threaded bores 45, 52 in the bridge and the main body, and also the threaded bolts 64. In the longitudinal direction, the threaded bolts 64 have a cylindrical section with a smooth surface and a section with a thread. The bores of the bearing plates 54, 55 and the associated threaded bores 45, 52 of bridge and main body are aligned in an operating state, and the threaded bolts 64 are plugged through abovementioned bores and screwed into the threaded bores.

Figure 15:
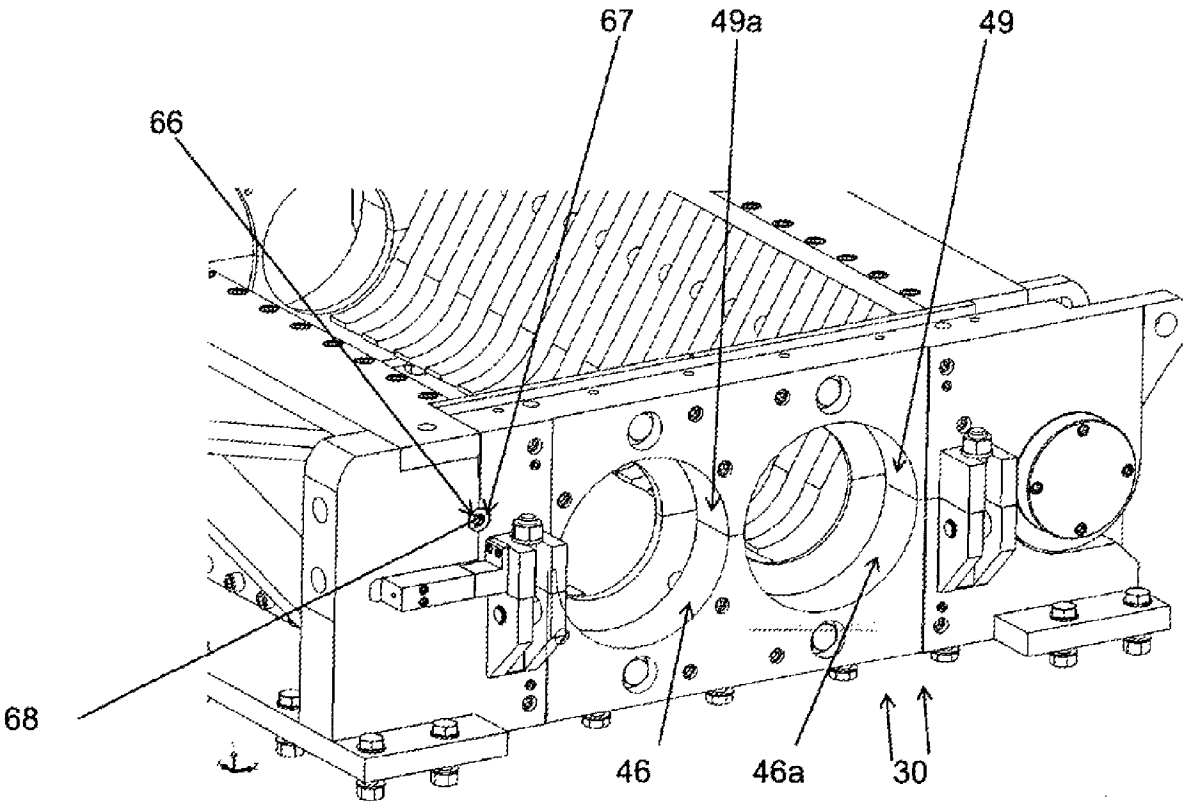
FIG. 15 is a perspective view of the disintegrating machine according to the invention.

The fixing device can furthermore contain a first semicircular bore 66 in the bridge and a second semicircular bore 67 in the main body (see FIG. 15). The semicircular bores are preferably oriented parallel to the knife shafts 21, 22 and, in a closed state of the bridge, that is operating state of the disintegrating machine, complement each other to form a circular bore. A securing bolt 68 which can counteract a swinging-up of the bridge can be inserted in the bore.

In order to transfer the disintegrating machine from an operating state into a maintenance state, the fixing device, in particular the nuts of the brackets 44, 51, the screws, the threaded bolts 64 and the securing bolts 68, are released.

The quick change couplings 16, 26 are subsequently released. In particular, only three screws 72 have to be released per quick change coupling. If the flanges 16, 26 are separated from each other, the respective drive 11, 12 can be folded away rearward to a sufficiently far extent by the suspension by the rubber springs 15.

The bridges 38 together with the hopper 3 can be subsequently swung up. The internals of the disintegrating machine and in particular the knife shafts 21, 22 are then accessible and can be lifted out of the frame 23 together with the bearings 25 since the pivoted-up bridge 38 likewise releases the bearings 25 of the knife shafts 21, 22.

The knife shafts 21, 22 can be lifted out, for example with a crane, and, by means of the standing feet 57, can be deposited on the bearing plates on, for example, the ground. Here, for example, damaged draw-in hooks of the knife disks can be repaired.

The scrapers 24 and in particular the fastening screws thereof are also accessible in the maintenance state. A scraper 24 can thus be removed from the frame or reinserted by release of just one screw 65 or two screws 65, in the variant with two screws, and this is basically also possible with the knife shafts still inserted.

After maintenance and repair, the knife shafts 21, 22 can be reinserted and the fixing device correspondingly fitted again.

In the preferred embodiment described here of the disintegrating machine, the drives 11, 12, the knife shafts 21, 22 and diverse functional elements are present in duplicate; furthermore, corresponding bearing receptacles are provided on both sides of the knife shafts 21, 22 and two bearing plates are provided on each knife shaft, i.e. accordingly a total of four bearing plates are provided. Generally, only an individual component is being described in the description, with it being possible for the statements to be correspondingly likewise transferred to the other identical components. It should also be taken into consideration that, in particular in FIGS. 7 and 9, optionally mirror-inverted illustrations of bridge and main body are depicted.

The disintegrating machine according to the invention, in particular a rotary cutter, is distinguished in particular by the below described features.

A disintegrating machine, in particular a rotary cutter, contains at least a first cutter shaft, a second cutter shaft, and a frame for receiving the cutter shafts which are mounted by bearings. The frame contains at least one side wall, wherein the side wall is equipped with reinforcing ribs.

A disintegrating machine, in particular a rotary cutter, contains at least a first cutter shaft, a second cutter shaft, and a frame for receiving the cutter shafts which are mounted by means of bearings. A driving device for driving the cutter shafts is provided, wherein the driving device has at least one drive which is connected to the first cutter shaft. The drive is connected to the cutter shaft by a quick change coupling.

A disintegrating machine, in particular a rotary cutter, contains at least a first cutter shaft, a second cutter shaft and a hopper, and also a frame for receiving the cutter shafts which are mounted by bearings. The frame is configured at least in sections as a bearing receptacle, the bearing receptacle contains a main body and a bridge. A releasable bearing plate is fitted between the main body and the bridge, wherein the bearing plate can act as a connecting element between the main body and the bridge, and/or the bearing plate can act as a stand for the cutter shaft which is connected thereto, and/or the bearing plate can be provided with an opening for the hooking-in of a crane hook or basically for the connection to a crane, and/or the bearing plate can act as a bearing receptacle of the shaft mounting.

A disintegrating machine, in particular a rotary cutter, contains at least a number of scrapers and a frame for receiving at least two cutter shafts, wherein at least one scraper is fastened by just one screw and a hook.

A disintegrating machine, in particular a rotary cutter, contains at least a first cutter shaft, a second cutter shaft and a hopper, and also a frame for receiving the cutter shafts which are mounted by bearings. The frame is configured at least in sections as a bearing receptacle. The bearing receptacle contains a main body and a bridge, wherein the bridge is fitted to the main body by a bearing, in particular a play-free bearing, preferably a tilting pedestal bearing, wherein the hopper is fitted on the bridge.

The disintegrating machine, in particular the rotary cutter, can be distinguished by all or some of the preceding enumerated features.

The following is a summary list of reference numerals and the corresponding structure used in the above description of the invention:

1 driving device
2 disintegrating device
3 hopper
4 mount
5 follow-up pressing device

11 first driving means
12 second driving means
13 motor
14 transmission
15 spring and/or damping element
16 flange (driving means)
21 first knife shaft
22 second knife shaft
23 frame
24 scraper
25 bearing (of the knife shaft)
26 flange (of the knife shaft)
27 first side wall
28 second side wall
29 first end wall
30 second end wall
31 distance space (of the scrapers)
32 distance bushing (on the shaft)
33 knife disk
34 axis of rotation
35 reinforcing rib
36 bore (in the flange)
37 main body
37*a* main body
38 bridge
38*a* bridge
39 play-reduced bearing
40 longitudinal side (of the main body)
41 first limb (of the main body)
42 second limb (of the main body)
43 bore (of the limb/main body)
44 bracket with pivotable threaded rod
45 threaded bore (in the longitudinal side/main body)
46 semicircular recess (in the main body)
46*a* semicircular recess (in the main body)
47 longitudinal side (in the bridge)
48 limb (in the bridge)
49 semicircular recess (in the bridge)
49*a* semicircular recess (in the bridge)
50 threaded bore (in the end wall of the bridge)
51 receptacle (in the bridge)
52 threaded bore (in the longitudinal side of the bridge)
53 bearing plate
54 first bolt leadthrough (in the bearing plate)
55 second bolt leadthrough (in the bearing plate)
56 shaft leadthrough (in the bearing plate)
57 standing foot
58 opening (in the bearing plate for connection of a crane)
59 threaded bore (in the scraper)
60 hook (in the scraper)
61 carrier
61*a* clearance (for carrier)
62 strip
63 bore (in the strip)
64 threaded bolt
65 screw (in the scraper)
66 first semicircular bore (for securing bolt)
67 second semicircular bore (for securing bolt)
68 securing bolt
69 screw
70 shaft
71 bearing ring
72 screw

The invention claimed is:

1. A disintegrating machine, comprising:

knife shafts including a first knife shaft and a second knife shaft;

a frame having bearing receptacles, each of said bearing receptacles having a main body and a bridge being pivotable in relation to said main body;

bearings; and a driving device for driving said knife shafts, said knife shafts accommodated rotatably in said bearing receptacles, including said main body and said bridge, of said frame by said bearings.

2. The disintegrating machine according to claim 1, further comprising at least one quick change coupling, said driving device is connected to at least one of said knife shafts by said at least one quick change coupling.

3. The disintegrating machine according to claim 1, further comprising at least one scraper fitted on that side of said frame which faces said knife shafts, said at least one scraper is connected to said frame only by a screw and a hook or only by two screws.

4. The disintegrating machine according to claim 1, wherein:

at least one of said knife shafts has an end side with at least one bearing plate, said bearing plate having at least one of:

a standing foot which, with respect to an axis of rotation of said one knife shaft, is at a greater distance from the axis of rotation than a largest radius of said one knife shaft;

an opening formed therein for a hooking-in of a crane hook or for connection to a crane; or a connection for one of said bearings for said one knife shaft.

5. The disintegrating machine according to claim 1, wherein said frame has reinforcing ribs at least in sections.

6. The disintegrating machine according to claim 5, wherein said frame has at least a first side wall, a second side wall, a first end wall and a second end wall.

7. The disintegrating machine according to claim 6, wherein said bearing receptacles include:

a first bearing receptacle having a first main body and a first bridge being pivotable in relation to said first main body, and disposed in said first end wall or forms said first end wall; and a second bearing receptacle having a second main body and a second bridge being pivotable in relation to said second main body, and disposed in said second end wall, wherein said first and second bridges each have two semicircular recesses formed therein and said first and second main bodies each have two semicircular recesses formed therein.

8. The disintegrating machine according to claim 1, further comprising a hopper for supplying recyclable materials to said knife shafts, said hopper is disposed on said bridge.

9. The disintegrating machine according to claim 1, further comprising a further bearing disposed between said main body and said bridge.

10. The disintegrating machine according to claim 1, further comprising at least one releasable fixing device disposed between said bridge and said main body.

11. The disintegrating machine according to claim 10, wherein:

said main body is of an U-shaped configuration and has a longitudinal side, a first limb and a second limb;

said bridge is of a L-shaped configuration and has a longitudinal side and a limb;

said at least one releasable fixing device contains at least one of:

at least two bores formed in said second limb of said main body, two threaded bores on an end side of said longitudinal side of said bridge and two screws, said two bores run parallel to said longitudinal side of said main body and said threaded bores run parallel to said longitudinal side of said bridge, wherein, in an operating state of the disintegrating machine, said screws are screwed through said bores into said threaded bores;

at least one bracket with a pivotable threaded rod on said main body or on said bridge, and at least one receptacle on said bridge or on said main body, wherein, in the operating state of the disintegrating machine, said threaded rod can be pivoted into said receptacle and fixed by means of a nut;

at least a first bore and a second bore formed in said bearing plate and a threaded bore in said main body and a threaded bore in said bridge and two threaded bolts, wherein, in the operating state of the disintegrating machine, said threaded bolts are screwed through said bores into said threaded bores; or a first semicircular bore formed in said bridge, a second semicircular bore formed in said main body, said first and second semicircular bores complement each other in the operating state of the disintegrating machine to form a circular bore, and a securing bolt inserted releasably into said bore.

12. The disintegrating machine according to claim 2, wherein said quick change coupling has a first flange and a second flange, both said first flange and said second flange have three bores formed therein each for screws for connection of said first and second flanges; and further comprising only one carrier disposed between said first and second flanges.

13. The disintegrating machine according to claim 5, wherein said reinforcing ribs are fitted to said walls.

14. The disintegrating machine according to claim 6, wherein said reinforcing ribs run diagonally between corners of said first and second side walls.

15. The disintegrating machine according to claim 4, wherein said connection of said bearing plate for said bearing of said knife shaft is in a form of a bearing ring, said bearing ring and said bearing plate are either formed integrally or said bearing ring is connected to said bearing plate.

16. The disintegrating machine according to claim 1, further comprising quick change couplings including a first quick change coupling and a second quick change coupling, said driving device is connected to said knife shafts by said quick change couplings, said first knife shaft is connected by said first quick change coupling and said second knife shaft is connected by said second quick change coupling to said driving device.

17. The disintegrating machine according to claim 3, wherein said at least one scraper is one of a plurality of scrapers.

18. The disintegrating machine according to claim 6, wherein said frame is a rectangular frame.

19. The disintegrating machine according to claim 7, further comprising a hopper for supplying recyclable materials to said knife shafts, said hopper is fitted to said first bridge of said first bearing receptacle and to said second bridge of the second bearing receptacle.

* * * * *